US008284000B2

(12) United States Patent
Fukunaga

(10) Patent No.: US 8,284,000 B2
(45) Date of Patent: Oct. 9, 2012

(54) RESONATOR AND FILTER

(75) Inventor: Tatsuya Fukunaga, Tokyo (JP)

(73) Assignee: TDK Corporation, Tokyo (JP)

( * ) Notice: Subject to any disclaimer, the term of this patent is extended or adjusted under 35 U.S.C. 154(b) by 322 days.

(21) Appl. No.: 12/662,001

(22) Filed: Mar. 26, 2010

(65) Prior Publication Data

US 2010/0244984 A1 Sep. 30, 2010

(30) Foreign Application Priority Data

Mar. 30, 2009 (JP) ..... 2009-081759

(51) Int. Cl.
*H01P 1/205* (2006.01)

(52) U.S. Cl. ..... 333/203; 333/219

(58) Field of Classification Search ..... 333/202, 333/203, 205, 219, 206
See application file for complete search history.

(56) References Cited

U.S. PATENT DOCUMENTS

| | | | | |
|---|---|---|---|---|
| 5,451,917 | A * | 9/1995 | Yamamoto et al. | 333/246 |
| 5,537,085 | A * | 7/1996 | McVeety | 333/206 |
| 5,886,597 | A * | 3/1999 | Riad | 333/245 |
| 5,905,420 | A * | 5/1999 | Tsujiguchi et al. | 333/206 |
| 5,994,978 | A * | 11/1999 | Vangala | 333/134 |
| 7,123,118 | B2 * | 10/2006 | McKinzie, III | 333/219 |
| 7,541,896 | B2 | 6/2009 | Fukunaga | |
| 7,561,012 | B2 | 7/2009 | Fukunaga | |
| 7,659,799 | B2 * | 2/2010 | Jun et al. | 333/212 |
| 2007/0171005 | A1 | 7/2007 | Fukunaga | |

FOREIGN PATENT DOCUMENTS

| | | |
|---|---|---|
| JP | A-08-335805 | 12/1996 |
| JP | A-10-028006 | 1/1998 |
| JP | A-2003-218604 | 7/2003 |
| JP | A-2007-60618 | 3/2007 |
| JP | A-2007-180684 | 7/2007 |
| JP | A-2007-201764 | 8/2007 |
| JP | A-2007-235857 | 9/2007 |
| JP | A-2008-60903 | 3/2008 |
| JP | B2-4195036 | 10/2008 |

* cited by examiner

*Primary Examiner* — Seungsook Ham
(74) *Attorney, Agent, or Firm* — Oliff & Berridge, PLC

(57) ABSTRACT

A resonator includes: a dielectric block; first and second ground electrodes provided on or in the dielectric block, and disposed to oppose each other; a first via conductor provided in the dielectric block orthogonally to the first and second ground electrodes, and having a short-circuit end connected to the first ground electrode and an open end extending toward the second ground electrode; a second via conductor interdigitally-coupled with the first via conductor, and provided in the dielectric block orthogonally to the first and second ground electrodes, and having a short-circuit end connected to the second ground electrode and an open end extending toward the first ground electrode; a first capacitor electrode provided in the dielectric block, and connected to the first via conductor; and a second capacitor electrode provided in the dielectric block, and connected to the second via conductor.

8 Claims, 31 Drawing Sheets

RESONATOR AND FILTER

BACKGROUND OF THE INVENTION

1. Field of the Invention

The present invention relates to a resonator and to a filter, which are small in size and suitable for wireless communication devices such as a cellular telephone.

2. Description of the Related Art

There has been a demand for a reduction in size of a filter used in wireless communication devices such as a cellular telephone, and the reduction in size has accordingly been demanded also for resonators structuring the filter. To achieve the reduction in size, a filter which utilizes a TEM (Transverse Electro-Magnetic) line to structure the resonator has been developed. In general, a comb-line coupling and an interdigital coupling are two techniques for coupling the two resonators having the TEM line. Japanese Patent Application Unexamined Publication No. 2003-218604 discloses a stacked resonator utilizing the comb-line coupling. Japanese Patent Registration No. 4195036 discloses a stacked resonator utilizing the interdigital coupling.

SUMMARY OF THE INVENTION

FIG. 29 illustrates a configuration in which a pair of resonators 111 and 112 are coupled through the comb-line coupling. FIG. 30 illustrates a configuration in which the pair of resonators 111 and 112 are coupled through the interdigital coupling. Each of the resonators 111 and 112 has a one end serving as an open end, and the other end serving as a short-circuit end. As illustrated in FIG. 29, the "comb-line coupling" is a coupling method which provides a configuration in which the two resonators 111 and 112 are so disposed that the mutual short-circuit ends are opposed to each other, and that the mutual open ends are opposed to each other. The "interdigital coupling" is a coupling method which provides a configuration in which the two resonators 111 and 112 are so disposed to oppose each other that the open end of one of the resonators (the resonator 111) and the short-circuit end of the other resonator (the resonator 112) are opposed to each other, and that the short-circuit end of one of the resonators (the resonator 111) and the open end of the other resonator (resonator 112) are opposed to each other, as illustrated in FIG. 30. It is known that a coupling coefficient "k" of the comb-line coupling establishes the following equation:

$$k=ke-Km$$

and that the coupling coefficient k of the interdigital coupling establishes the following equation:

$$k=ke+km$$

where "ke" is a coupling coefficient by an electric field, and "km" is a coupling coefficient by a magnetic field, respectively. It is also known that, in the interdigital coupling, an electric field coupling and a magnetic field coupling do not cancel each other unlike the comb-line coupling, and thus extremely strong coupling is obtained as compared with the comb-line coupling.

FIG. 31 illustrates a basic configuration of a filter utilizing pairs of resonators each coupled through the interdigital coupling. The filter is provided with a first resonator 101, a second resonator 102, an input terminal 104, and an output terminal 105. The first resonator 101 has the pair of resonators 111 and 112 which are coupled to each other through the interdigital coupling. The second resonator 102 has another pair of resonators 121 and 122 which are coupled to each other through the interdigital coupling. The input terminal 104 is connected to the first resonator 101. The output terminal 105 is connected to the second resonator 102.

A stacked dielectric filter may be contemplated for structuring the filter illustrated in FIG. 31. The stacked dielectric filter is provided with a dielectric block having a multilayered structure and a substantially rectangular-parallelepiped configuration, and configured of a dielectric material, for example. Inside of the dielectric block is formed with conductor line patterns (i.e., strip lines), which form the pair of resonators 111 and 112, another pair of resonators 121 and 122, the input terminal 104, and the output terminal 105 as an inner layer. The first resonator 101 and the second resonator 102 are disposed side-by-side in a generally parallel fashion (i.e., in generally planar fashion), to allow the first resonator 101 and the second resonator 102 to be electromagnetically coupled to each other. In this configuration, most of the electric field is coupled between the mutually-opposed resonators of the pair of resonators 111 and 112 and of another pair of resonators 121 and 122. Thus, the coupling by the electric field hardly occurs between the adjacent first resonator 101 and the second resonator 102, and the coupling by the magnetic field occurs therebetween. That is, the coupling coefficient by the electric field (ke) between the first resonator 101 and the second resonator 102 is almost equal to zero (0), and the coupling coefficient (k) therebetween is almost equal to the coupling coefficient by the magnetic field (km). The strong coupling between the first resonator 101 and the second resonator 102 is suitable for configuring a broadband bandpass filter.

A filter, which is smaller in size than that utilizing the comb-line coupling, is structured when the pair of resonators utilizing the interdigital coupling is used. In the following, description thereof will be given in detail, based on the condition that each of the pair of resonators 111 and 112 and another pair of resonators 121 and 122 is configured of a pair of quarter wavelength resonators.

First, description will be given on resonant modes of the pair of quarter wavelength resonators which are coupled through the interdigital coupling. First of all, resonant modes of an example where two resonators, each of which resonates at the same frequency, are coupled will be discussed with reference to FIGS. 34 and 35. When a distance between the two resonators is large, resonance peaks are overlapped mutually at the same frequency since the resonators do not couple each other at all. However, when the two resonators are brought close to each other, each of the resonators no longer resonates solely since intrusion (or interference) of radio waves occurs, thereby forming a hybrid resonant mode in which the resonant modes of the two resonators are mixed, and dividing the resonance peak into two. When assuming that the two resonant modes in the hybrid resonant mode are a first resonant mode (mode 1) and a second resonant mode (mode 2) respectively, bases (i.e. a lower part) of the resonance peaks of the two resonant modes are overlapped to each other as illustrated in FIG. 34 in a case where the coupling between the two resonators is weak, since a degree of the division is small. In this case, a resonance frequency $f_2$ of the second resonant mode, being as the lower resonant mode, slightly contains a component of the first resonant mode, since the resonance peak of the first resonant mode is overlapped therewith. On the other hand, when the coupling between the two resonators is strong, the resonant peaks are away from each other. As illustrated in FIG. 35, this makes it possible to produce a state having no component of the first resonant mode in the resonance frequency $f_2$ at which the second resonant mode resonates. This means that, in other words, it is possible to increase a purity of the resonant modes by making the coupling between the resonators strong.

In the pair of quarter wavelength resonators 111 and 112 which are coupled through the interdigital coupling, a condition of resonance can be divided into the two unique resonant modes. The same applies to another pair of quarter wavelength resonators 121 and 122. FIG. 32 illustrates the first resonant mode of the pair of quarter wavelength resonators 111 and 112 which are coupled through the interdigital coupling, and FIG. 33 illustrates the second resonant mode thereof. In FIGS. 32 and 33, a dashed curve represents a distribution of an electric field E in each of the resonators 111 and 112. Also, FIGS. 32 and 33 illustrate respectively a state in which the pair of quarter wavelength resonators 111 and 112 resonate. FIGS. 32 and 33 further illustrate respectively a state in which one end is grounded, meaning that the quarter wavelength resonators 111 and 112 are at a zero potential in terms of alternating current.

In the first resonant mode, a current "i" flows from the open end to the short-circuit end in each of the quarter wavelength resonators 111 and 112, and directions of the current i flowing in the quarter wavelength resonators 111 and 112 are opposite to each other. A portion denoted by "+V" in FIG. 32 represents the open end side, and that a potential is relatively high. In the first resonant mode, electromagnetic waves are excited in phase by the quarter wavelength resonators 111 and 112, and a phase and amplitude of the electric field E become the same at positions, which are rotationally symmetric to each other relative to physical rotational symmetry axes of the entire quarter wavelength resonators 111 and 112. In other words, the first resonant mode corresponds to a common mode. When balanced terminals 104A and 104B are connected to the rotationally symmetric positions, common mode signals are outputted from the pair of balanced terminals 104A and 104B, in the first resonant mode.

On the other hand, in the second resonant mode, the current i flows from the open end to the short-circuit end in one of the quarter wavelength resonators (the resonator 111), and the current i flows from the short-circuit end to the open end in the other quarter wavelength resonators (the resonator 112). Thus, the directions of the current i flowing in the quarter wavelength resonators 111 and 112 are in the same direction to each other. A portion denoted by "+V" in FIG. 33 represents the open end side, and that a potential is relatively high, whereas a portion denoted by "−V" represents the open end side, and that the potential is relatively low. That is, as can be seen from the distributions of the electric fields E in the second resonant mode, the electromagnetic waves are excited in opposite phase by the quarter wavelength resonators 111 and 112. In the second resonant mode, the phases of the electric fields E differ at an angle of 180 degrees, and absolute values of the amplitudes are the same, at the positions rotationally symmetric to each other relative to the physical rotational symmetry axes of the entire quarter wavelength resonators 111 and 112. In other words, the second resonant mode corresponds to a differential mode. When the balanced terminals 104A and 104B are connected to the rotationally symmetric positions, balanced signals having a good amplitude balance and a good phase balance are taken from the pair of balanced terminals 104A and 104B, in the second resonant mode.

FIG. 36 illustrates a distribution state of the resonance frequencies of the pair of quarter wavelength resonators 111 and 112 which are coupled through the interdigital coupling. The interdigital coupling has a characteristic that an intermediate resonance frequency $f_0$ between a first resonance frequency $f_1$ and the second resonance frequency $f_2$ is a frequency of each resonator, resonating at a quarter wavelength which is determined by a physical length of a line (i.e., the intermediate resonance frequency $f_0$ is a resonance frequency of each single quarter wavelength resonator where the respective quarter wavelength resonators are not coupled through the interdigital coupling). Thus, it is possible to allow the resonator as a whole to be smaller in size than that of a case where a pass frequency is set at the resonance frequency $f_0$, by setting the second resonance frequency $f_2$, which is low in frequency, as the pass frequency. For example, when designing a filter in which a 2.4 GHz band is set as the pass frequency, quarter wavelength resonators each having a physical length corresponding to 8 GHz may be used, for example. This allows the filter to be smaller in size than that of a case where quarter wavelength resonators, each having a physical length corresponding to the 2.4 GHz band, are used. Also, in the second resonant mode, a magnetic field distribution, which is equivalent to a circumstance in which the pair of quarter wavelength resonators 111 and 112 are assumed as a virtual single conductor, is obtained when the coupling between the resonators is made strong. Thus, the second resonant mode is also advantageous in that a thickness of conductor is increased virtually, and that a conductor loss is thereby reduced.

Accordingly, a favorable bandpass filter having the reduced size and the reduced conductor loss is achieved when the pass frequency as a filter is set at the second resonance frequency $f_2$ of the second resonant mode. Further, since the interdigital coupling provides the strong coupling, the broadband bandpass filter is achieved.

Each of the stacked resonators disclosed in Japanese Patent Application Unexamined Publication No. 2003-218604 and Japanese Patent Registration No. 4195036 structures a plurality of electrodes configuring the resonator by conductor line patterns, and arranges those electrode patterns vertically in a stacked fashion, such that a thickness of conductors in a stack direction is increased to reduce a conductor loss, and that a size of the stacked resonator is reduced as a whole. In particular, the stacked resonator disclosed in Japanese Patent Registration No. 4195036 couples the stacked electrode patterns with the interdigital coupling to achieve further reduction in size, by utilizing the characteristic of the interdigital coupling described above. However, currently-available stacked resonators, including those described in Japanese Patent Application Unexamined Publication No. 2003-218604 and Japanese Patent Registration No. 4195036, arrange ground electrodes or shield electrodes in the stack direction (i.e., in the vertical direction) of the electrode patterns configuring the resonator. Thus, when attempting to reduce a thickness in the currently-available stacked resonators, the upper and the lower electrode patterns configuring the resonator are consequently so disposed close to the upper and the lower ground electrodes (or the upper and the lower shield electrodes) that those electrode patterns oppose those ground electrodes or those shield electrodes. As a result, an eddy current loss may be produced in the ground electrodes (or the shield electrodes) due to an influence of the opposed electrode patterns, and thus the conductor loss in the resonator may be increased. Therefore, reduction of loss and thickness may not be satisfied with ease.

It is desirable to provide a resonator and a filter, capable of satisfying both reduction of loss and reduction of thickness.

A resonator according to an embodiment of the invention includes: a dielectric block; a first ground electrode and a second ground electrode provided on or in the dielectric block so as to oppose each other; a first via conductor provided in the dielectric block so as to extend in a direction orthogonal to faces of the first and second ground electrodes, and having a short-circuit end and an open end, the short-circuit end being connected to the first ground electrode, and the open end extending toward the second ground electrode; a second via conductor interdigitally-coupled with the first via conductor, and provided in the dielectric block so as to extend in the direction orthogonal to faces of the first and second ground electrodes, and having a short-circuit end and an open end, the short-circuit end being connected to the second ground electrode, and the open end extending toward the first ground electrode; a first capacitor electrode provided in the dielectric block, and connected to the first via conductor; and a second capacitor electrode provided in the dielectric block, and connected to the second via conductor.

In the resonator according to the embodiment of the invention, electrodes for resonance are structured by the via conductors, and the via conductors are provided in the direction orthogonal to the first ground electrode and the second ground electrode which are opposed to each other. Thus, unlike currently-available stacked resonators, the electrodes for resonance and the ground electrodes are not disposed to oppose each other even when a thickness of the resonator is reduced. Accordingly, a conductor loss is reduced as compared with existing stacked structures. Further, each of the via conductors serving as the electrodes for resonance is connected with the corresponding capacitor electrode. Thus, a resonance frequency is reduced, and further reduction of size is achieved accordingly.

Advantageously, the first capacitor electrode is connected to the open end of the first via conductor, and is so disposed to oppose the second ground electrode that a first capacitor is formed with the first capacitor electrode and the second ground electrode, and the second capacitor electrode is connected to the open end of the second via conductor, and is so disposed to oppose the first ground electrode that a second capacitor is formed with the second capacitor electrode and the first ground electrode.

Advantageously, the first and second capacitor electrodes are so disposed to oppose each other in the direction to which the first and second via conductors extend, that a capacitor is formed with the first and second capacitor electrodes.

Advantageously, the first capacitor electrode is provided on an inner side of the dielectric block relative to the second ground electrode, and is provided with an opening in a region corresponding to a position at which the second via conductor is provided such that the first capacitor electrode is electrically isolated from the second via conductor, and the second capacitor electrode is provided on the inner side of the dielectric block relative to the first ground electrode, and is provided with an opening in a region corresponding to a position at which the first via conductor is provided such that the second capacitor electrode is electrically isolated from the first via conductor.

Advantageously, the first ground electrode is provided on an inner side of the dielectric block relative to the second capacitor electrode, and is provided with an opening in a region corresponding to a position at which the second via conductor is provided such that the first ground electrode is electrically isolated from the second via conductor, and the second ground electrode is provided on the inner side of the dielectric block relative to the first capacitor electrode, and is provided with an opening in a region corresponding to a position at which the first via conductor is provided such that the second ground electrode is electrically isolated from the first via conductor.

Advantageously, the resonator further includes: a third via conductor provided in the dielectric block so as to extend in the direction orthogonal to faces of the first and second ground electrodes, and having a short-circuit end and an open end, the short-circuit end of the third via conductor being connected to the first ground electrode, and the open end of the third via conductor extending toward the second ground electrode; and a fourth via conductor provided in the dielectric block so as to extend in the direction orthogonal to faces of the first and second ground electrodes, and having a short-circuit end and an open end, the short-circuit end of the fourth via conductor being connected to the second ground electrode, and the open end of the fourth via conductor extending toward the first ground electrode. Advantageously, every couple of via conductors immediately neighboring on one another, selected from the first to fourth via conductors, are interdigitally coupled with each other, the first capacitor electrode is connected with the first and third via conductors, and the second capacitor electrode is connected with the second and fourth via conductors.

Advantageously, the first to fourth via conductors are disposed in a substantially square-shaped configuration within a plane parallel to the first and second ground electrodes.

A filter according to an embodiment of the invention includes: a dielectric block; and a first resonator and a second resonator provided in the dielectric block, in parallel to each other, so as to be electromagnetically coupled to each other. Each of the first and second resonators includes: a first ground electrode and a second ground electrode provided on or in the dielectric block so as to oppose each other; a first via conductor provided in the dielectric block so as to extend in a direction orthogonal to faces of the first and second ground electrodes, and having a short-circuit end and an open end, the short-circuit end being connected to the first ground electrode, and the open end extending toward the second ground electrode; a second via conductor interdigitally-coupled with the first via conductor, and provided in the dielectric block so as to extend in the direction orthogonal to faces of the first and second ground electrodes, and having a short-circuit end and an open end, the short-circuit end being connected to the second ground electrode, and the open end extending toward the first ground electrode; a first capacitor electrode provided in the dielectric block, and connected to the first via conductor; and a second capacitor electrode provided in the dielectric block, and connected to the second via conductor.

In the filter according to the embodiment of the invention, the filter(s) according to the embodiment of the invention is used. Accordingly, reduction in loss and reduction in thickness of the filter as a whole are achieved with ease.

Advantageously, each of the first and second ground electrodes is configured as a common electrode serving for the first resonator as well as for the second resonator, and the filter further includes coupling adjusting via conductors provided between the first and second resonators to penetrate the dielectric block from the common first ground electrode to the common second ground electrode, the coupling adjusting via conductor adjusting coupling magnitude between the first and second resonators.

The providing of the coupling adjusting via conductor makes it easier to adjust the degree of coupling between the first resonator and the second resonator, and to obtain desired filter characteristics.

According to the resonator of the embodiment of the invention, the electrodes for resonance are structured by the via conductors, and the via conductors are provided in the direction orthogonal to the ground electrodes. Thus, unlike currently-available stacked resonators, the electrodes for resonance and the ground electrodes are not disposed to oppose each other even when a thickness of the resonator is reduced.

Accordingly, a conductor loss, in a case where the thickness is reduced, is reduced as compared with existing stacked structures. Further, each of the via conductors serving as the electrodes for resonance is connected with the corresponding capacitor electrode. Thus, a resonance frequency is reduced, and further reduction of size is achieved accordingly. Therefore, it is possible to satisfy both the reduction of loss and the reduction of thickness.

According to the filter of the embodiment of the invention, the first resonator and the second resonator are disposed in parallel to each other such that the first resonator and the second resonator are electromagnetically coupled to each other, and each of the first resonator and the second resonator is configured with the resonator according to the embodiment of the invention. Therefore, it is possible to satisfy both the reduction of loss and the reduction of thickness of the filter as a whole.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the specification, serve to explain the principles of the invention.

FIG. 23A to FIG. 24D are cross-sectional views taken in a plane of the resonator according to the comparative example illustrated in FIG. 21, respectively.

FIG. 24 is a perspective view illustrating an Example of a filter utilizing the resonator according to the embodiments of the invention.

DETAILED DESCRIPTION OF THE PREFERRED EMBODIMENTS

Hereinafter, an embodiment of the present invention will be described in detail with reference to the accompanying drawings.

First Embodiment

First Configuration Example

Figure 1:
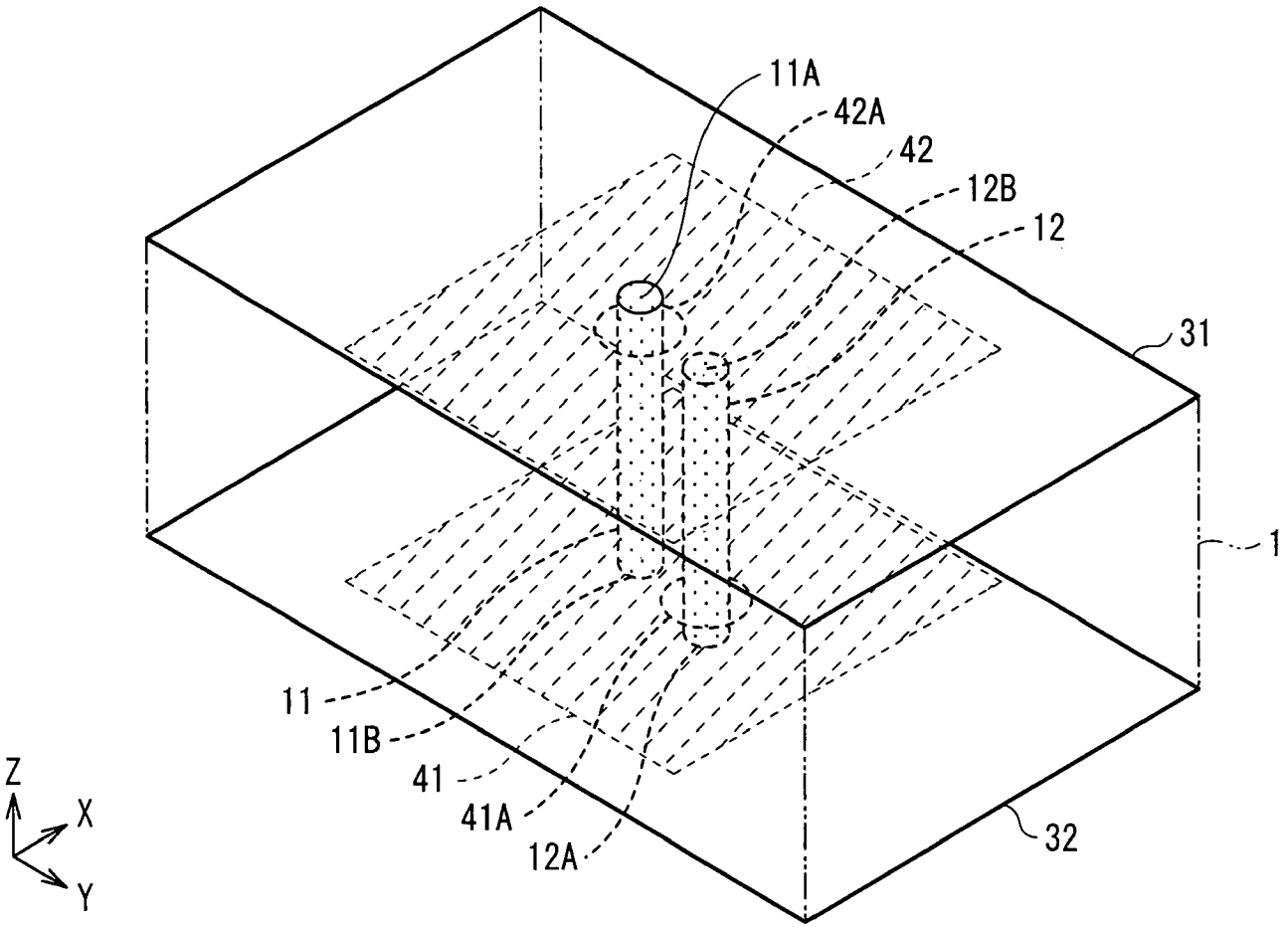
FIG. 1 is a perspective view illustrating a first configuration example of a resonator according to a first embodiment of the invention.
Figure 2:
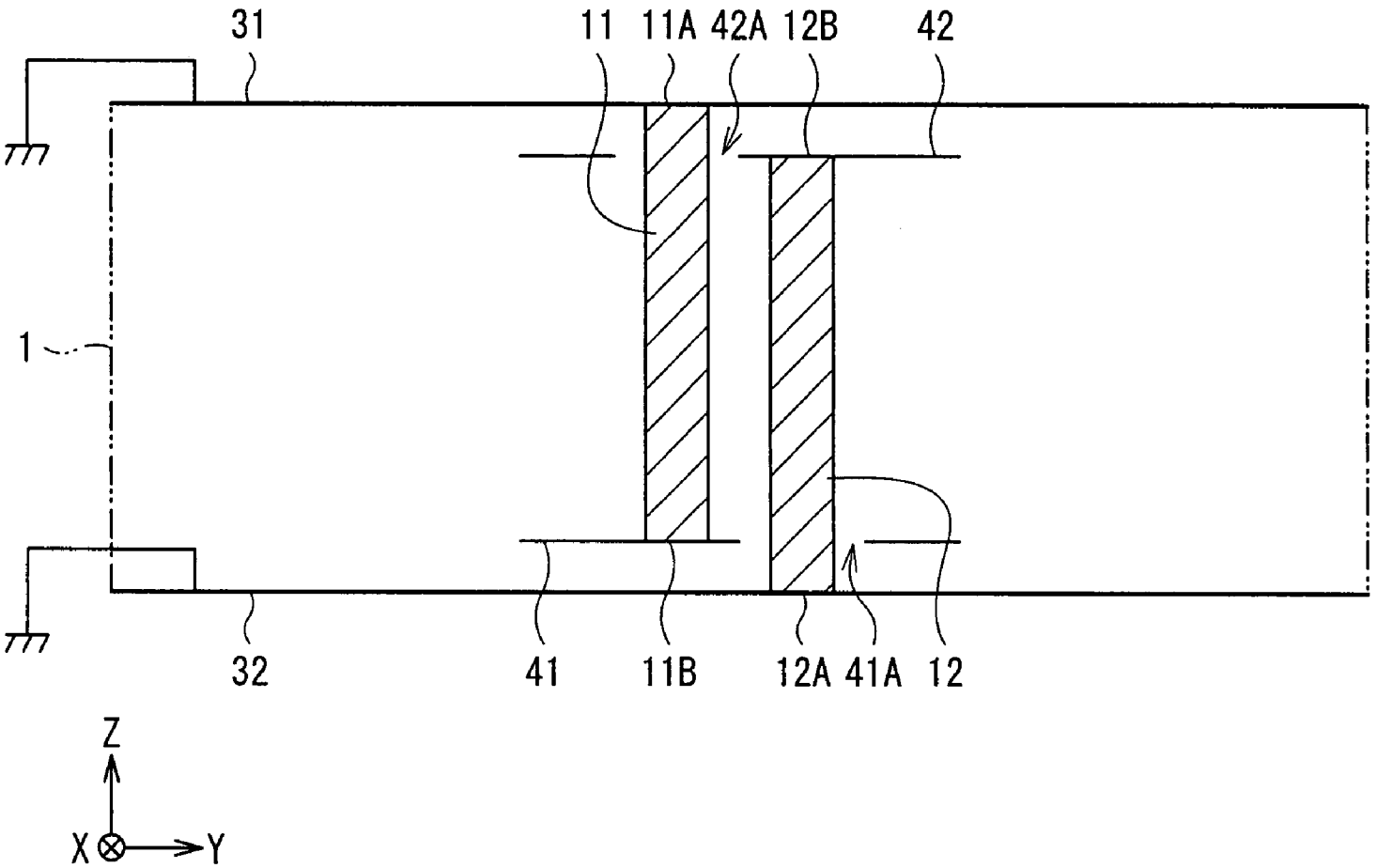
FIG. 2 is a cross-sectional view taken along a side of the resonator illustrated in FIG. 1.
Figure 3A:
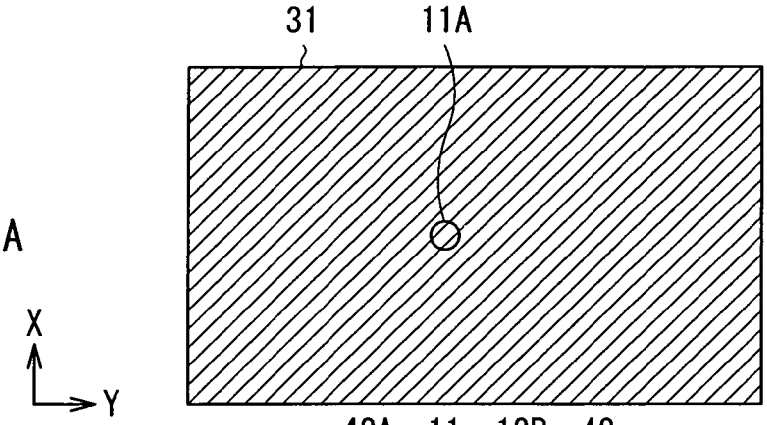
FIG. 3A to FIG. 3D are cross-sectional views taken in a plane of the resonator illustrated in FIG. 1, respectively.
Figure 3B:
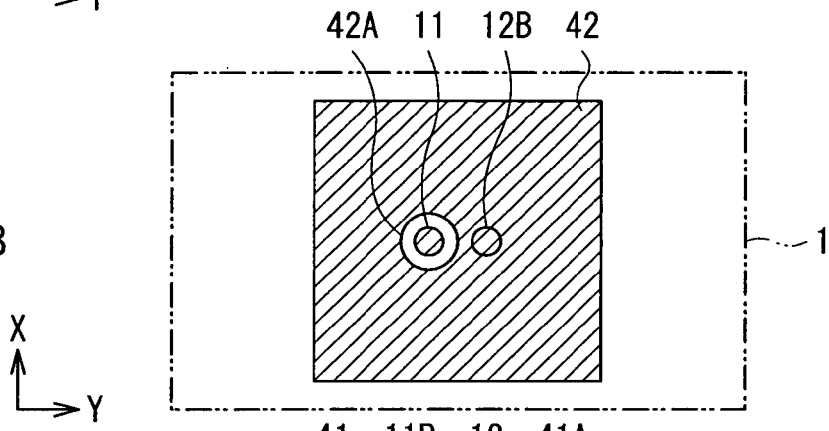
Figure 3C:
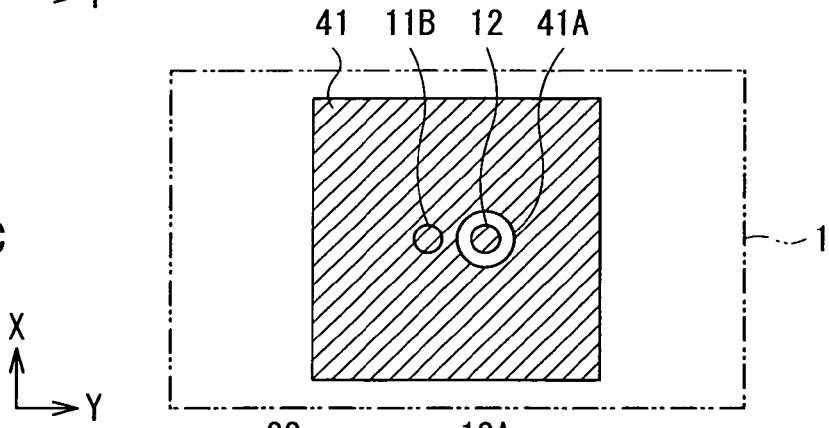
Figure 3D:
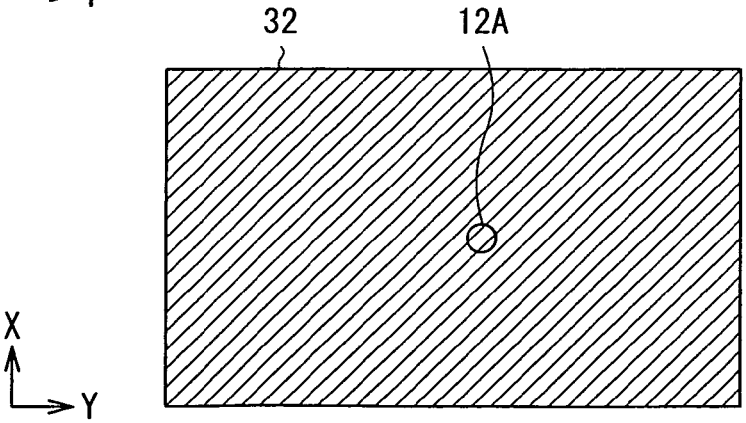

FIG. 1 illustrates a first configuration example of a resonator according to a first embodiment of the invention. FIG. 2 illustrates a cross-section taken along a side of the resonator illustrated in FIG. 1 (i.e., the cross-section taken along a ZY-plane and seen from an X-axis direction in FIG. 1). FIG. 3A to FIG. 3D illustrate cross-sections taken along a plane of the resonator illustrated in FIG. 1 (the cross-sections taken along a XY-plane and seen from above in FIG. 1), respectively.

The resonator is provided with a dielectric block 1, a first ground electrode 31, a second ground electrode 32, a first via conductor 11, a second via conductor 12, a first capacitor electrode 41, and a second capacitor electrode 42. The dielectric block 1 generally has a substantially rectangular-parallelepiped configuration, and configured of a dielectric material. Each of the first ground electrode 31 and the second ground electrode 32 is formed inside or on a surface of the dielectric block 1. The respective electrodes are stacked in order of the first ground electrode 31 (FIG. 3A), the second capacitor electrode 42 (FIG. 3B), the first capacitor electrode 41 (FIG. 3C), and the second ground electrode 32 (FIG. 3D), from a top layer of the dielectric block 1.

Each of the first ground electrode 31 and the second ground electrode 32 is disposed to oppose each other. The first ground electrode 31 is formed entirely in a planar fashion on a top surface of the dielectric block 1. The second ground electrode 32 is formed entirely in a planar fashion on a bottom surface of the dielectric block 1.

The first via conductor 11 is formed in the dielectric block 1 in a direction orthogonal to the first ground electrode 31 and the second ground electrode 32 (i.e., formed in a direction parallel to a Z-axis in FIG. 1). The first via conductor 11 has a first end which is connected to the first ground electrode 31 and serving as a short-circuit end 11A, and a second end which extends toward a direction in which the second ground electrode 32 is disposed (i.e., extends toward the direction which is along the bottom surface of the dielectric block 1), and serving as an open end 11B. Similarly, the second via conductor 12 is formed in the dielectric block 1 in the direction orthogonal to the first ground electrode 31 and the second ground electrode 32. The second via conductor 12 has a first end which is connected to the second ground electrode 32 and serving as a short-circuit end 12A, and a second end which extends toward a direction in which the first ground electrode 31 is disposed (i.e., extends toward the direction which is along the upper surface of the dielectric block 1), and serving as an open end 12B.

Each of the first via conductor 11 and the second via conductor 12 has, for example, a substantially circular cross-section (the cross-section orthogonal to the extending direction of the first and the second via conductors 11 and 12). At least an inner wall surface of each of the first via conductor 11 and the second via conductor 12 is covered with a conductor. An inside part of each of the first via conductor 11 and the second via conductor 12 may have a hollow shape, or may be generally embedded with the conductor. The first via conductor 11 and the second via conductor 12 respectively serve as electrodes for resonance, and structure a pair of quarter wavelength resonators which are coupled to each other through an interdigital coupling. As already discussed with reference to FIG. 32 to FIG. 36, the pair of interdigitally-coupled quarter wavelength resonators have a first resonant mode which resonates at a first resonance frequency $f_1$, and a second resonant mode which resonates at a second resonance frequency $f_2$ which is lower than the first resonance frequency $f_1$. These resonators are disposed adjacently and sufficiently close to each other such that a frequency separation in the two modes is well provided, and are so configured that an operating frequency during the resonance is at the second resonance frequency $f_2$.

The first capacitor electrode 41 is connected to the open end 11B of the first via conductor 11, and is so disposed to oppose the second ground electrode 32 that a first capacitor is formed with the first capacitor electrode 41 and the second ground electrode 32. The first capacitor electrode 41 is formed on an inner side of the dielectric block 1 relative to the second ground electrode 32 (i.e., formed on the top layer side of the dielectric block 1). The first capacitor electrode 41 is provided with an opening 41A in a region corresponding to a position at which the second via conductor 12 is formed, such that the first capacitor electrode 41 is electrically isolated from the second via conductor 12.

The second capacitor electrode 42 is connected to the open end 12B of the second via conductor 12, and is so disposed to oppose the first ground electrode 31 that a second capacitor is formed with the second capacitor electrode 42 and the first ground electrode 31. The second capacitor electrode 42 is formed on the inner side of the dielectric block 1 relative to the first ground electrode 31 (i.e., formed on the bottom layer side of the dielectric block 1). The second capacitor electrode 42 is provided with an opening 42A in a region corresponding to a position at which the first via conductor 11 is formed, such that the second capacitor electrode 42 is electrically isolated from the first via conductor 11.

Figure 4:
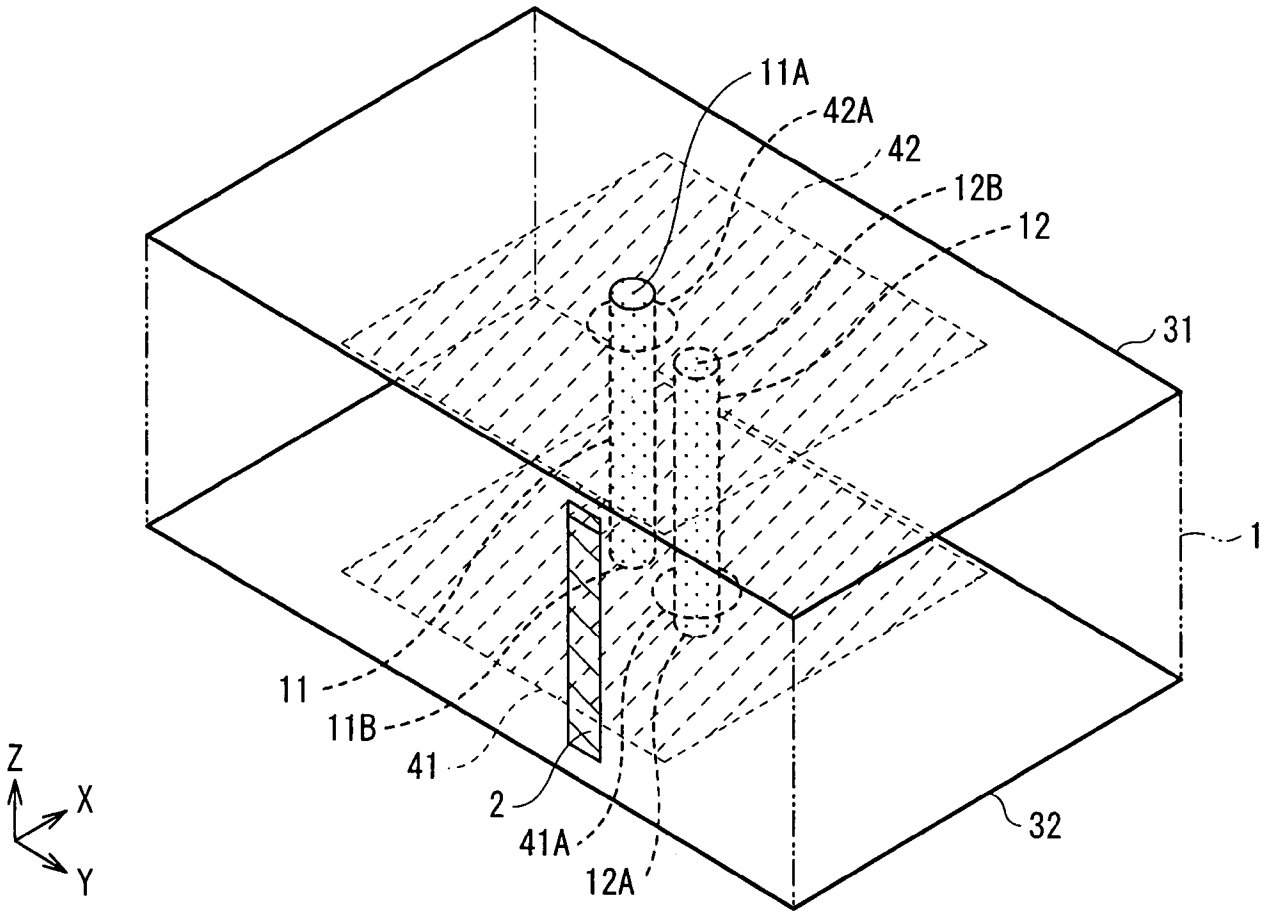
FIG. 4 is a perspective view illustrating a configuration example in which an input-output terminal is provided in the resonator illustrated in FIG. 1.

FIG. 4 illustrates a configuration example of a case where an input-output terminal is provided in the resonator. In this configuration example, an external terminal electrode 2 is formed on one side surface of the dielectric block 1. Further, a conductor pattern extends in a side surface direction from the second capacitor electrode 42, to allow the second capacitor electrode 42 and the external terminal electrode 2 to electrically conduct each other. Thereby, the open end 12B of the second via conductor 12 electrically conducts with the external terminal electrode 2 through the second capacitor electrode 42. Although not illustrated in the drawings, the open end 11B of the first via conductor 11 may be similarly connected to an external terminal electrode through the first capacitor electrode 41.

Second Configuration Example

Figure 5:
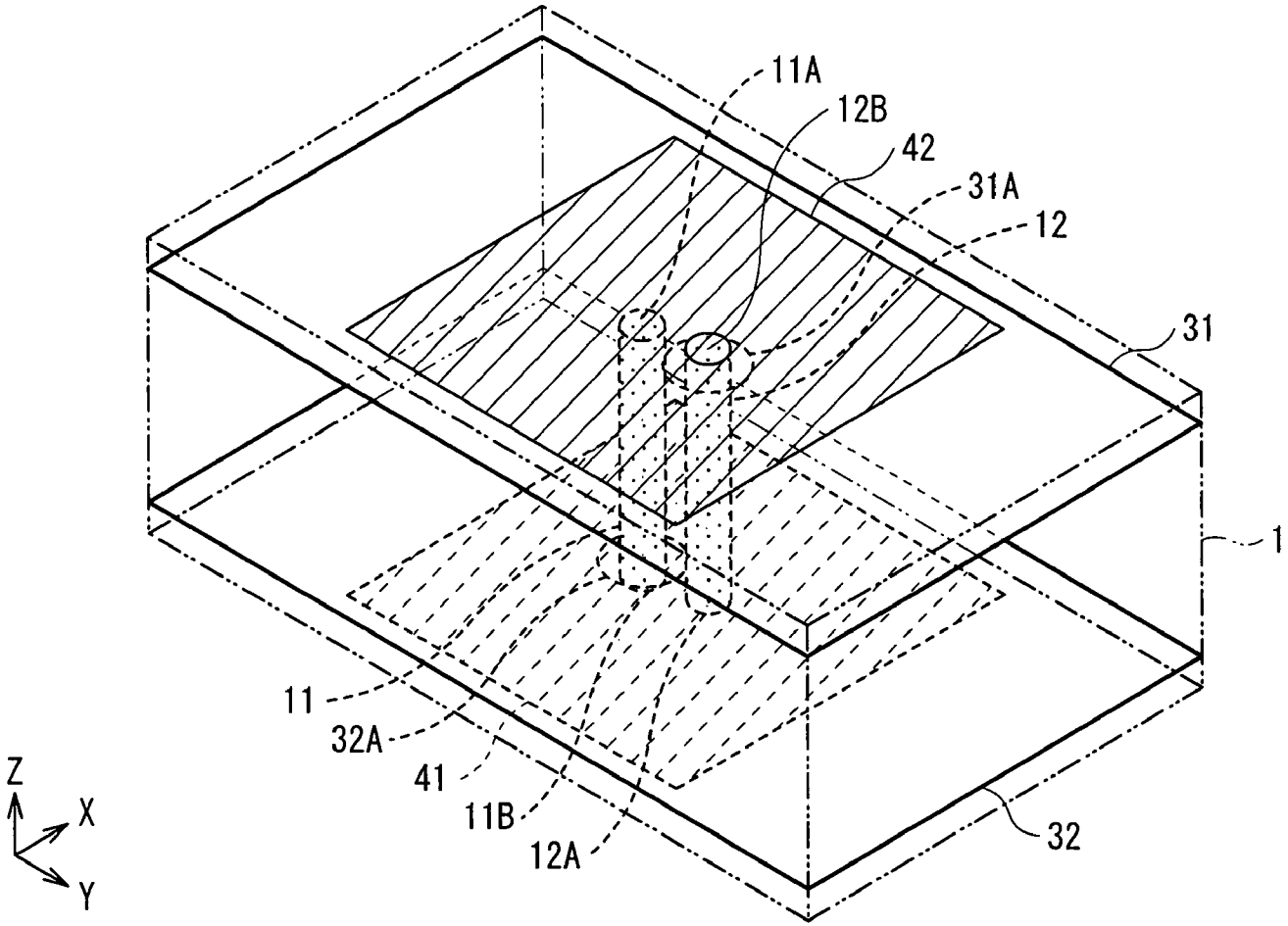
FIG. 5 is a perspective view illustrating a second configuration example of the resonator according to the first embodiment of the invention.
Figure 6:
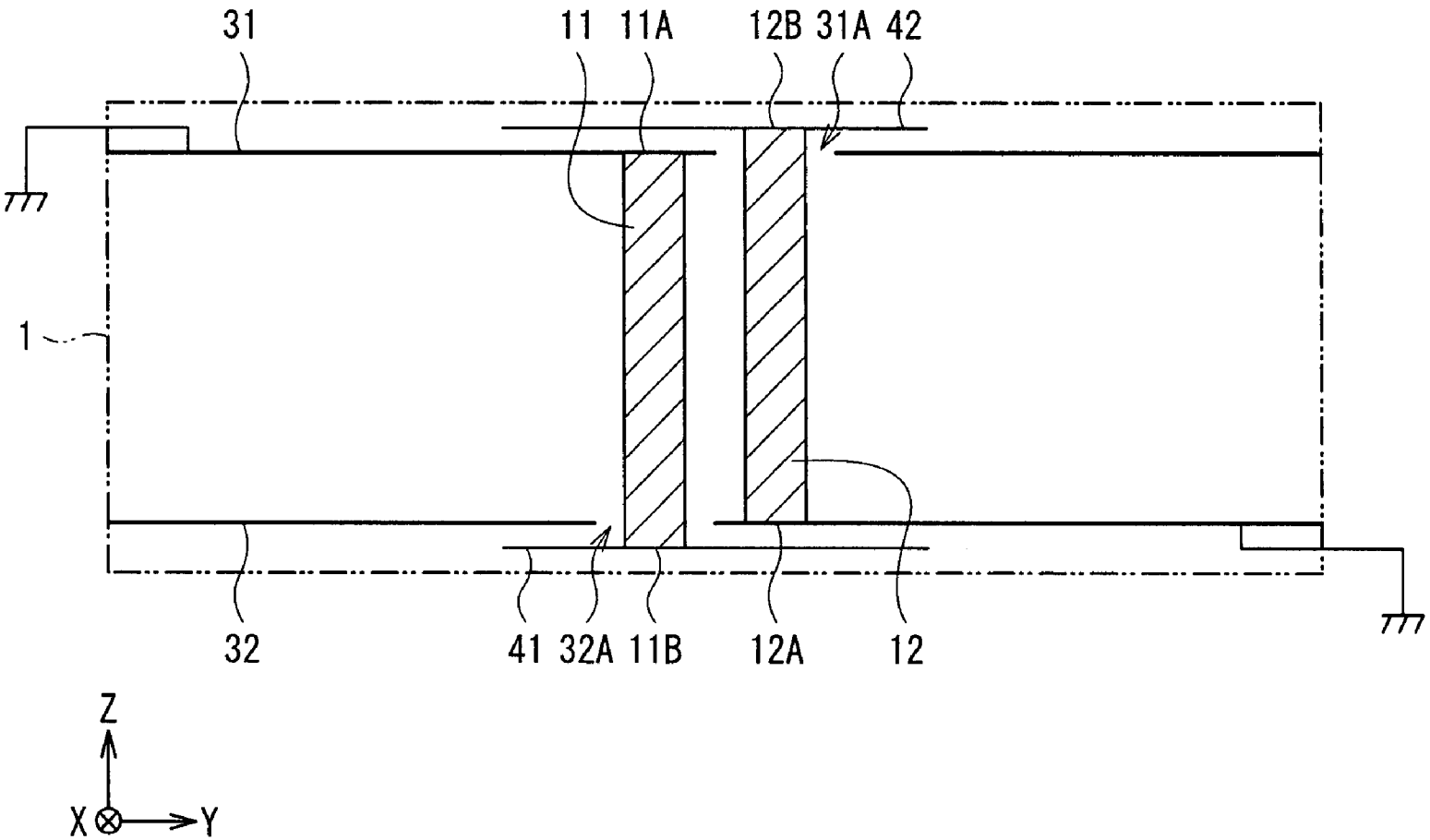
FIG. 6 is a cross-sectional view taken along a side of the resonator illustrated in FIG. 5.
Figure 7A:
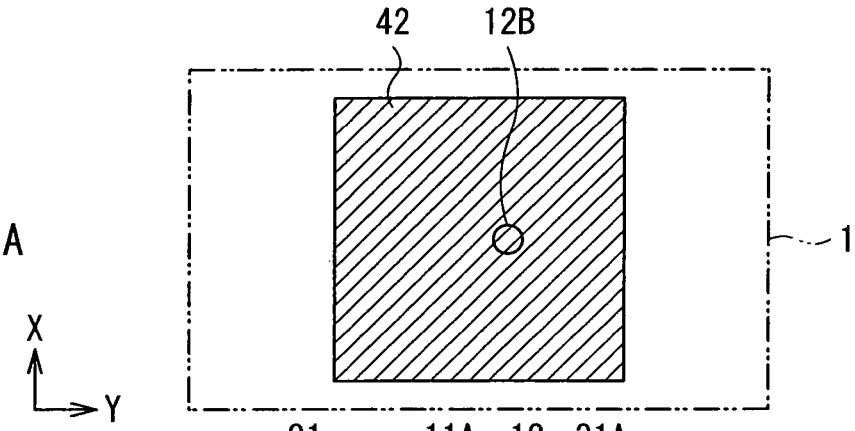
FIG. 7A to FIG. 7D are cross-sectional views taken in a plane of the resonator illustrated in FIG. 5, respectively.
Figure 7B:
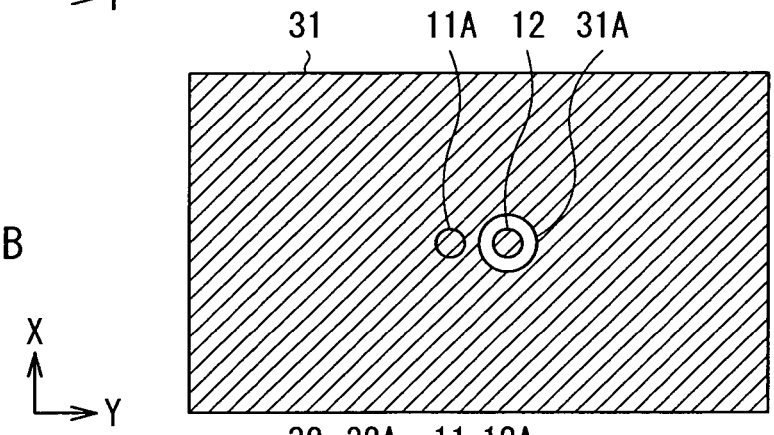
Figure 7C:
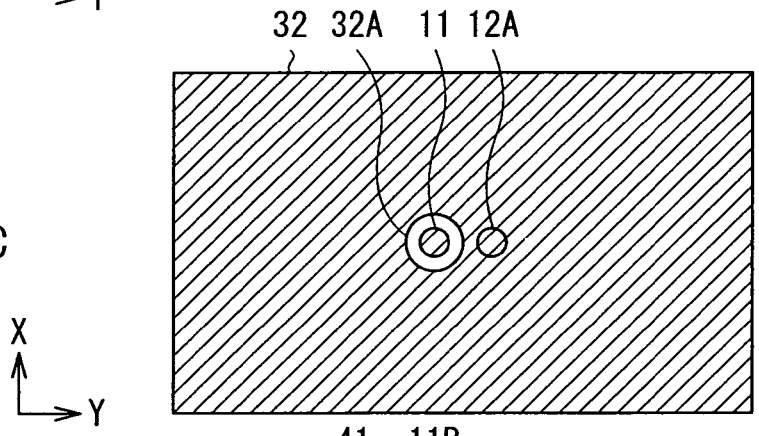
Figure 7D:
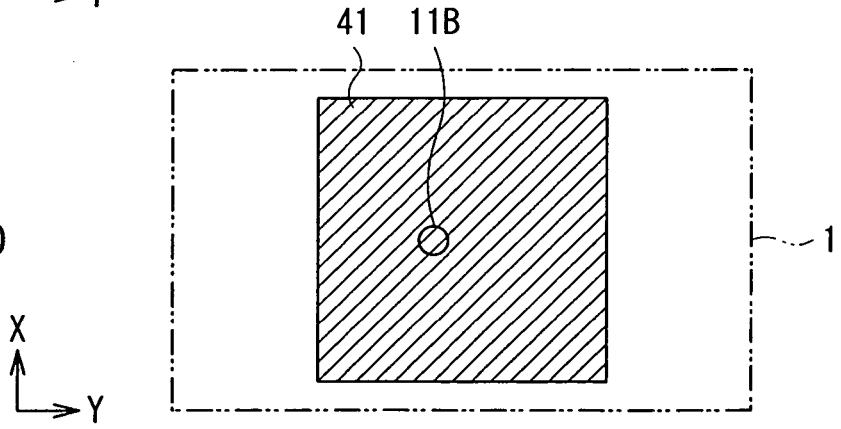

FIG. 5 illustrates a second configuration example of the resonator according to the first embodiment of the invention. FIG. 6 illustrates a cross-section taken along a side of the resonator illustrated in FIG. 5 (i.e., the cross-section taken along a ZY-plane and seen from an X-axis direction in FIG. 5). FIG. 7A to FIG. 7D illustrate cross-sections taken along a plane of the resonator illustrated in FIG. 5 (the cross-sections taken along a XY-plane and seen from above in FIG. 5), respectively.

The resonator according to the second configuration example differs from the resonator of the first configuration example illustrated in FIG. 1, in that an order of stack of the respective electrodes is altered. In the resonator according to the second configuration example, the respective electrodes are stacked in order of the second capacitor electrode 42 (FIG. 7A), the first ground electrode 31 (FIG. 7B), the second ground electrode 32 (FIG. 7C), and the first capacitor electrode 41 (FIG. 7D), from a top layer of the dielectric block 1.

In the second configuration example, the first ground electrode 31 is formed on the inner side of the dielectric block 1 relative to the second capacitor electrode 42 (i.e., formed on the bottom layer side relative to the second capacitor electrode 42). The first ground electrode 31 is provided with an opening 31A in a region corresponding to a position at which the second via conductor 12 is formed, such that the first ground electrode 31 is electrically isolated from the second via conductor 12. The second ground electrode 32 is formed on the inner side of the dielectric block 1 relative to the first capacitor electrode 41 (i.e., formed on the top layer side relative to the first capacitor electrode 41). The second ground electrode 32 is provided with an opening 32A in a region corresponding to a position at which the first via conductor 11 is formed, such that the second ground electrode 32 is electrically isolated from the first via conductor 11.

Third Configuration Example

Figure 8:
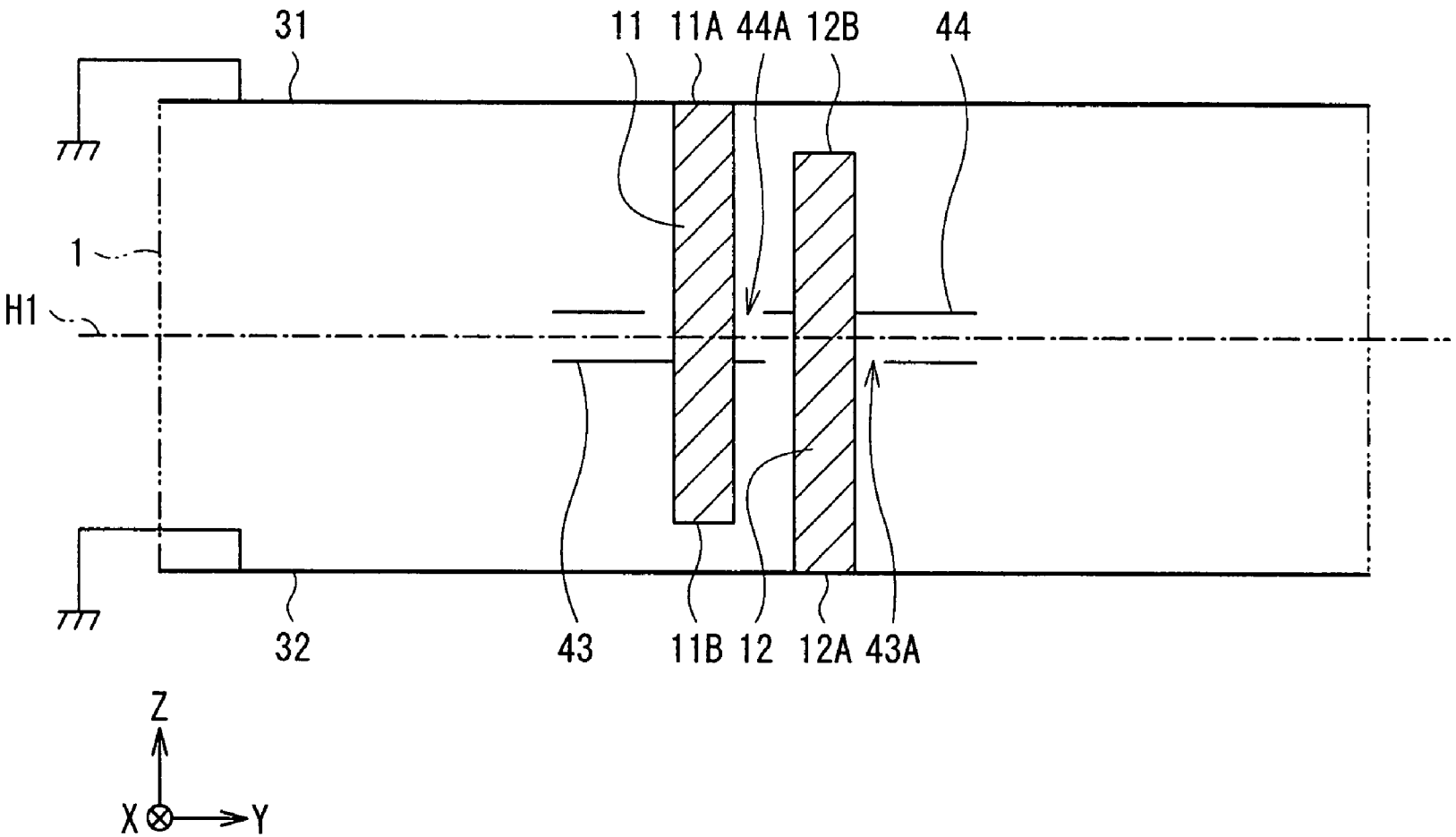
FIG. 8 is a cross-sectional view illustrating a third configuration example of the resonator according to the first embodiment of the invention.

FIG. 8 illustrates a third configuration example of the resonator according to the first embodiment of the invention, in which a cross-section taken along a side of the resonator is illustrated.

The resonator according to the third configuration example differs from the resonator of the first configuration example illustrated in FIG. 1, in that the positions at which the capacitor electrodes are formed are altered. In the third configuration example, a first capacitor electrode 43 is formed in an intermediate part of the first via conductor 11, and is connected to the first via conductor 11. Also, a second capacitor electrode 44 is formed in an intermediate part of the second via conductor 12, and is connected to the second via conductor 12. The first capacitor electrode 43 and the second capacitor electrode 44 are so disposed to oppose each other in the direction to which the first and the second via conductors 11 and 12 extend, that a capacitor is formed with the first capacitor electrode 43 and the second capacitor electrode 44. Thereby, the capacitor is formed in the intermediate part of each of the first via conductor 11 and the second via conductor 12. The first capacitor electrode 43 is provided with an opening 43A in a region corresponding to a position at which the second via conductor 12 is formed, such that the first capacitor electrode 43 is electrically isolated from the second via conductor 12. The second capacitor electrode 44 is provided with an opening 44A in a region corresponding to a position at which the first via conductor 11 is formed, such that the second capacitor electrode 44 is electrically isolated from the first via conductor 11.

It is preferable that the first capacitor electrode 43 and the second capacitor electrode 44 be formed at symmetrical positions in the direction to which the first and the second via conductors 11 and 12 extend. For example, when assuming that the resonator has a configuration in which a shape of the dielectric block 1 and a shape of the first and the second via conductors 11 and 12 are symmetrical to a center line H1 within the cross-section illustrated in FIG. 8, it is preferable that, in such an example, the first capacitor electrode 43 and the second capacitor electrode 44 be formed at positions symmetrical to the center line H1.

Fourth Configuration Example

Figure 9:
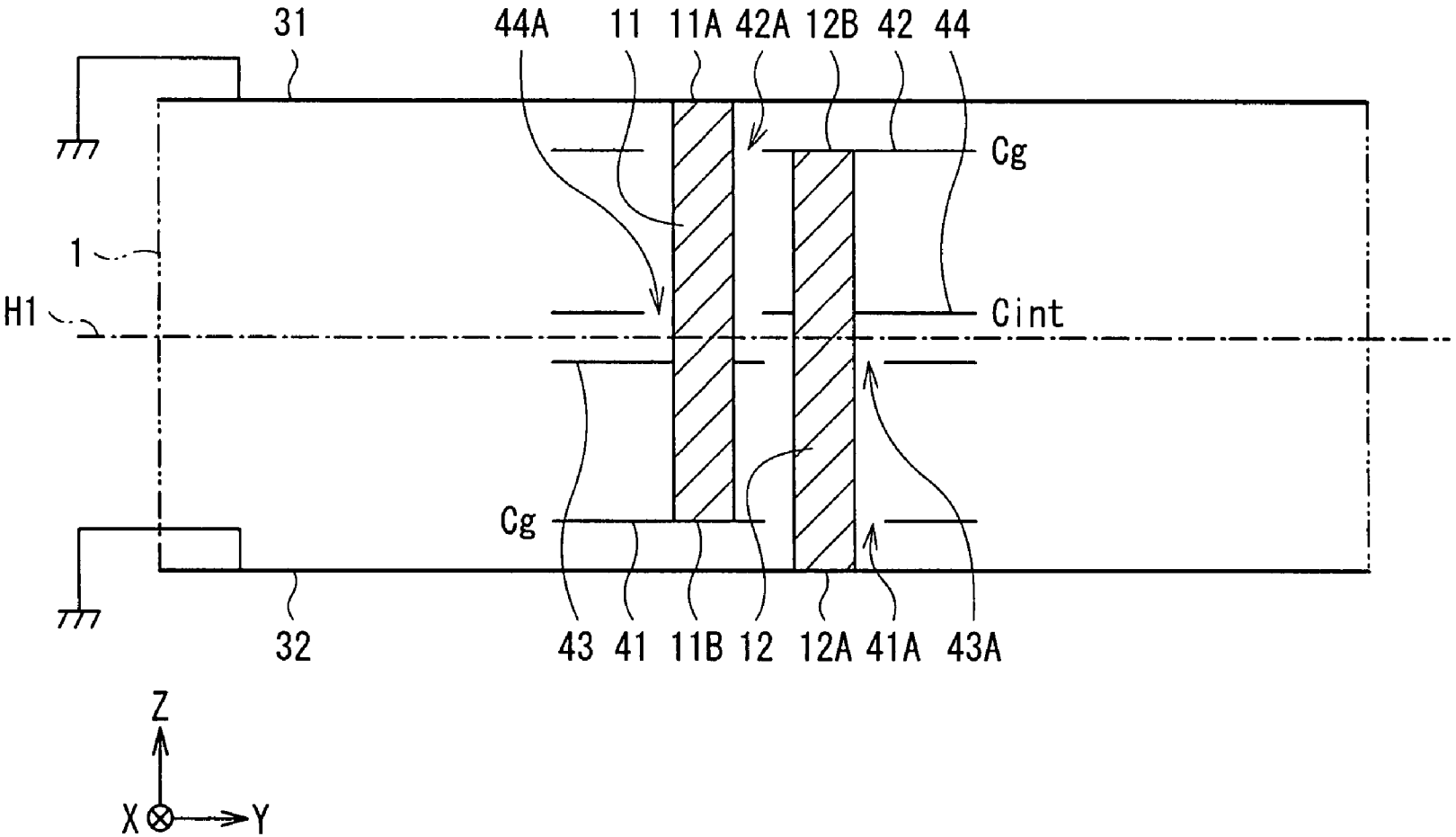
FIG. 9 is a cross-sectional view illustrating a fourth configuration example of the resonator according to the first embodiment of the invention.

FIG. 9 illustrates a fourth configuration example of the resonator according to the first embodiment of the invention, in which a cross-section taken along a side of the resonator is illustrated.

The resonator according to the fourth configuration example includes a combination of the configuration of the resonator according to the first configuration example illustrated in FIG. 1 and the configuration of the resonator according to the third configuration example illustrated in FIG. 8. That is, the capacitor electrodes are provided for both the open-end and the intermediate part of the via conductors. More specifically, the first capacitor electrode 41 is connected to the open end 11B of the first via conductor 11, and another first capacitor electrode 43 is connected to the intermediate part of the first via conductor 11. Also, the second capacitor electrode 42 is connected to the open end 12B of the second via conductor 12, and another second capacitor electrode 44 is connected to the intermediate part of the second via conductor 12. Thereby, a first capacitor is formed with the first capacitor electrode 41 and the second ground electrode 32, and a second capacitor is formed with the second capacitor electrode 42 and the first ground electrode 31. Further, a third capacitor is formed with another first capacitor electrode 43 and another second capacitor electrode 44.

[Operation and Effect of Resonator]

In each of the configuration examples described above, the resonator according to the present embodiment has the configuration in which the electrodes for resonance are structured by the first via conductor 11 and the second via conductor 12, and in which each of the first via conductor 11 and the second via conductor 12 is formed in the direction orthogonal to the first ground electrode 31 and the second ground electrode 32 which are opposed to each other. Thus, unlike currently-available stacked resonators, the electrodes for resonance and the ground electrodes will not be disposed to oppose each other even when a thickness of the resonator is reduced. Accordingly, a conductor loss is reduced as compared with existing stacked structures. Also, in the resonator according to the present embodiment, the first via conductor 11 and the second via conductor 12 are structured by the quarter wavelength resonators, which are coupled through the interdigital coupling, and having the first resonant mode which resonates at the first resonance frequency $f_1$ and the second resonant mode which resonates at the second resonance frequency $f_2$ which is lower than the first resonance frequency Accordingly, a reduction in size is achieved by utilizing a characteristic of the interdigital coupling, as has been already discussed above with reference to FIG. 32 to FIG. 36.

Further, in the resonator according to the present embodiment, each of the first via conductor 11 and the second via conductor 12 is connected with the capacitor electrode. Thus, a resonance frequency is reduced, and further reduction in size is achieved accordingly. In the following, an effect of providing the capacitor electrodes will be described with reference to the fourth configuration example illustrated in FIG. 9 as an example. The resonator here generally has the configuration which is symmetrical to the center line H1 within the cross section illustrated in FIG. 9.

Figure 10A:
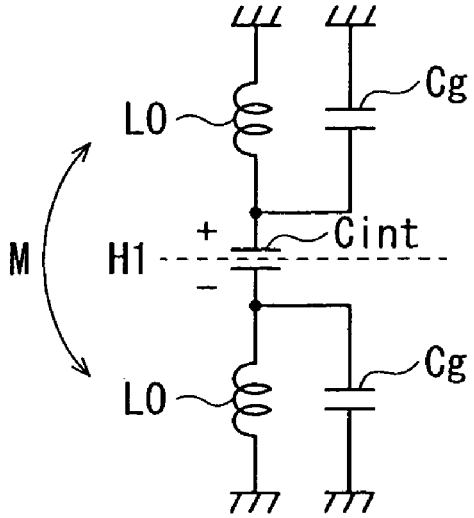
FIG. 10A and FIG. 10B are circuit diagrams illustrating respectively an equivalent circuit of the entire resonator illustrated in FIG. 9.

FIG. 10A illustrates an equivalent circuit of the entire resonator illustrated in FIG. 9. In this resonator, a first inductor having an inductance L0 is formed by the first via conductor 11 (i.e., the inductor in an upper part), and a second inductor having an inductance L0 is formed by the second via conductor 12 (i.e., the inductor in a lower part). The first via conductor 11 and the second via conductor 12 are magnetically coupled to form a mutual inductance M. Also, the first capacitor having a capacitance Cg is formed with the first capacitor electrode 41 and the second ground electrode 32, and the second capacitor having a capacitance Cg is formed with the second capacitor electrode 42 and the first ground electrode 31. Further, the third capacitor having a capacitance Cint is formed with another first capacitor electrode 43 and another second capacitor electrode 44.

Figure 10B:
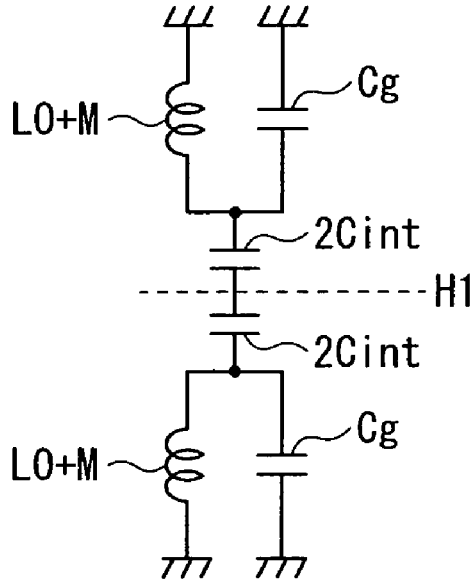
Figure 11:
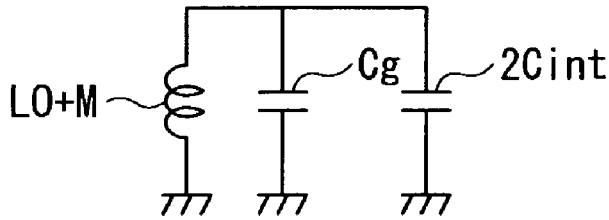
FIG. 11 illustrates an equivalent circuit of an upper part or a lower part of the resonator illustrated in FIG. 9.

When assuming that the upper half of the circuit illustrated in FIG. 10A is at a positive (+) potential, the lower half of the circuit is at a negative (−) potential, which means that a position right in the middle therebetween is at a zero potential. This can be represented equivalently by a circuit in which a twofold capacitance 2Cint is added to the upper half and the lower half as illustrated in FIG. 10B, assuming that the middle position is at the zero potential. Hence, an equivalent circuit of the upper part or the lower part in the resonator illustrated in FIG. 9 can be represented as illustrated in FIG. 11. A resonance frequency "f" of the circuit illustrated in FIG. 11 in this case is expressed by the following Equation, where L1 is a sum of the inductance L0 by the first via conductor 11 or the second via conductor 12 and the mutual inductance M between those two via conductors.

$$f = \frac{1}{2\pi\sqrt{L1(Cg + 2Cint)}},\ L1 = L0 + M \qquad \text{Formula 1}$$

As can be seen from the Equation for the resonance frequency f, the effect of reducing the resonance frequency f is obtained by increasing the capacitance Cg or the capacitance Cint. Accordingly, the resonance frequency is reduced by the configuration in which the capacitor electrode is connected to each of the first via conductor 11 and the second via conductor 12. This makes it possible to shorten a length of the via conductors, and to achieve the reduction in thickness.

Therefore, according to the resonator of the present embodiment of the invention, it is possible to satisfy both the reduction of loss and the reduction of thickness.

Second Embodiment

Hereinafter, a resonator according to a second embodiment of the invention will be described. Note that the same or equivalent elements as those of the resonator according to the first embodiment described above are denoted with the same reference numerals, and will not be described in detail.

The resonator according to the present embodiment differs from the resonator according to the first embodiment described above, in that the number of via conductors serving as the electrodes for resonance is increased. The present embodiment makes it possible to increase a resonant length equivalently, by increasing the number of via conductors. That is, further reduction in thickness is achieved when the resonance frequency, which is same as that, is maintained.

First Configuration Example of Second Embodiment

Figure 12:
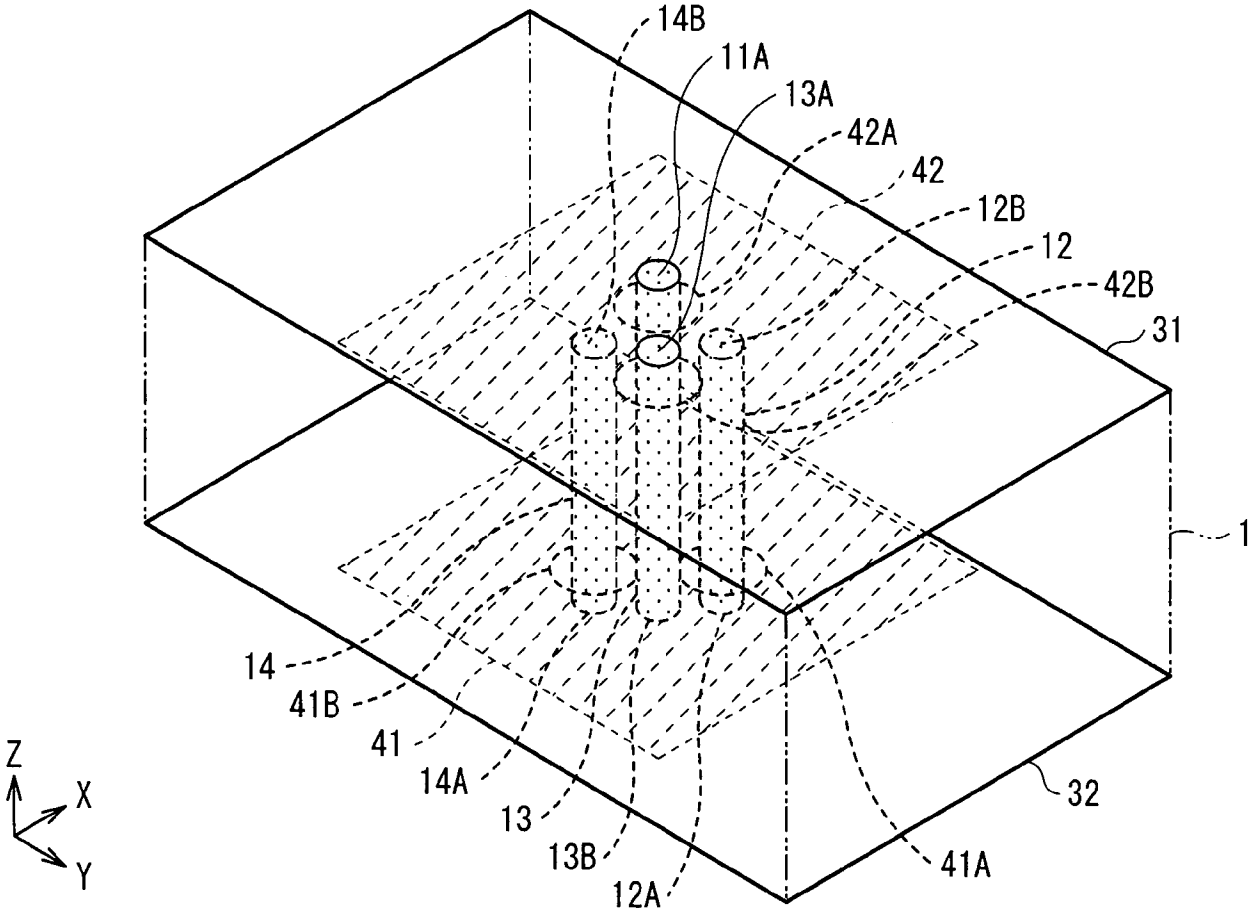
FIG. 12 is a perspective view illustrating a first configuration example of a resonator according to a second embodiment of the invention.
Figure 13A:
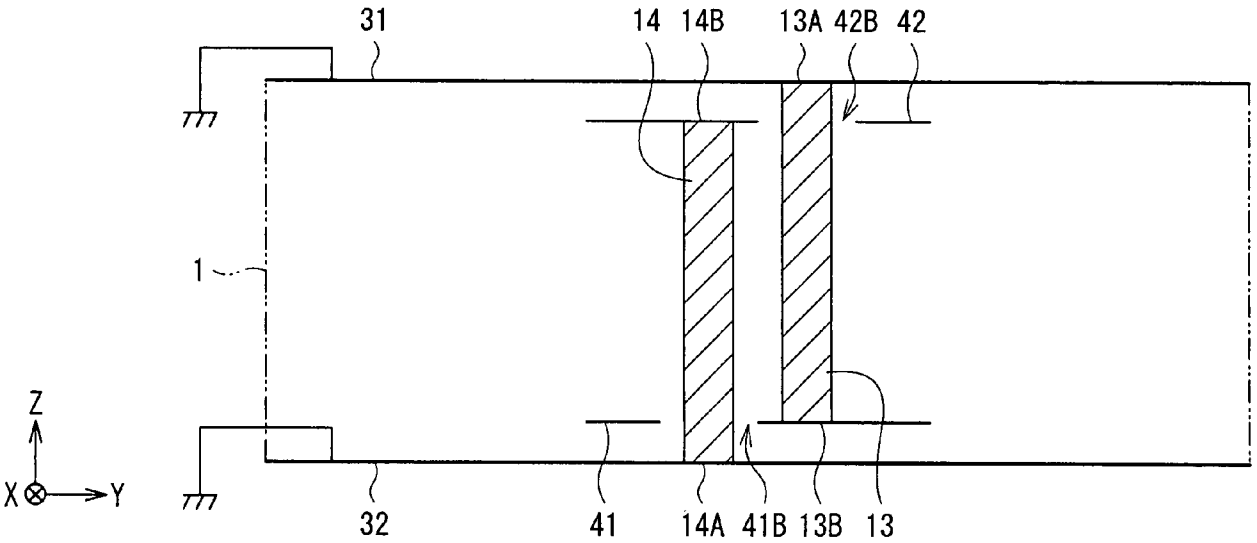
FIG. 13A and FIG. 13B are cross-sectional views taken along a side of the resonator illustrated in FIG. 12, respectively.
Figure 13B:
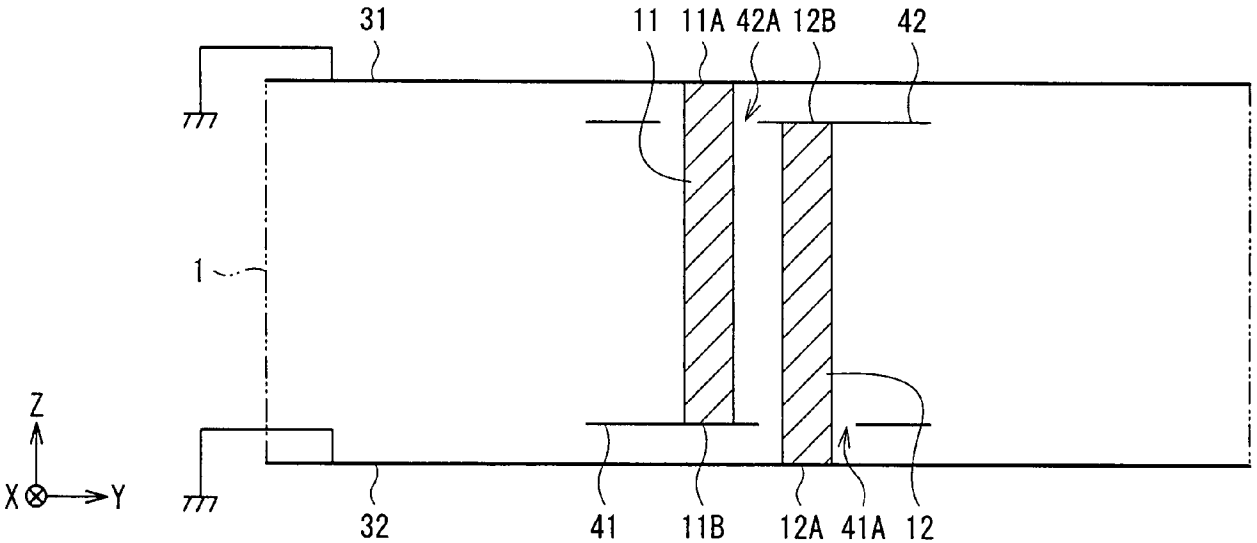
Figure 14A:
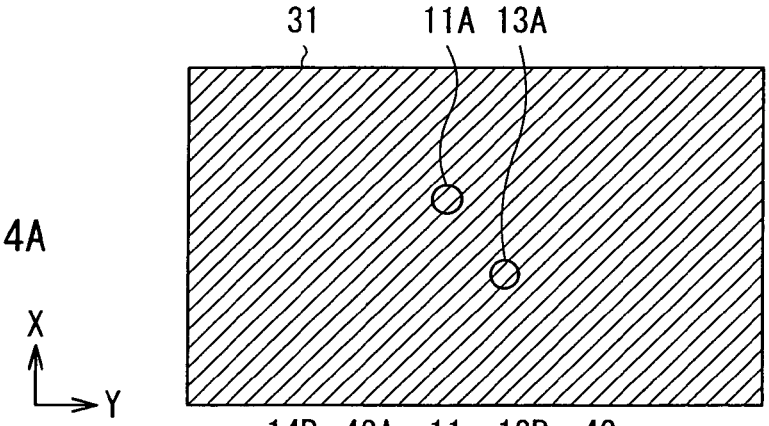
FIG. 14A to FIG. 14D are cross-sectional views taken in a plane of the resonator illustrated in FIG. 12, respectively.
Figure 14B:
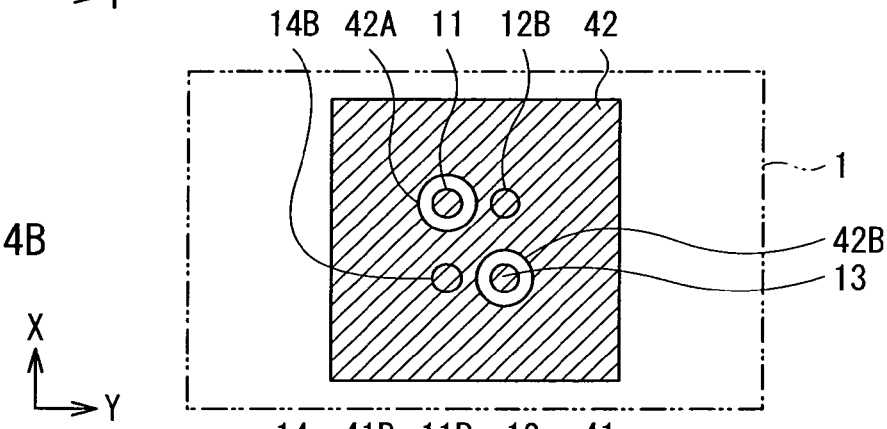
Figure 14C:
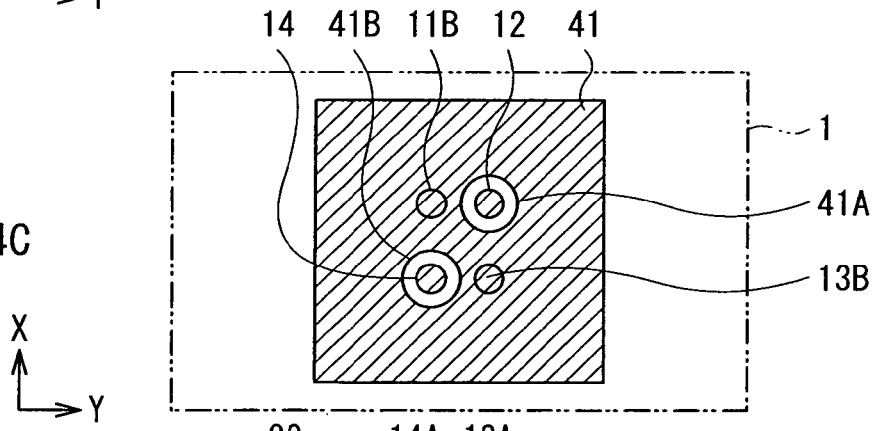
Figure 14D:
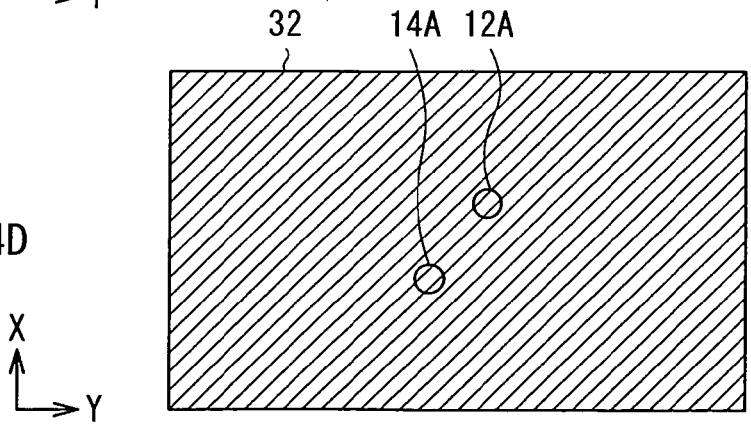

FIG. 12 illustrates a first configuration example of the resonator according to the present embodiment. FIG. 13A and FIG. 13B illustrate cross-sections taken along a side of the resonator illustrated in FIG. 12, respectively (i.e., the cross-sections taken along a ZY-plane and seen from an X-axis direction in FIG. 12). FIG. 14A to FIG. 14D illustrate cross-sections taken along a plane of the resonator illustrated in FIG. 12 (the cross-sections taken along a XY-plane and seen from above in FIG. 12), respectively.

The resonator according to the present configuration example further includes, with respect to the resonator illustrated in FIG. 1, a third via conductor 13 and a fourth via conductor 14 as the electrodes for resonance. FIG. 13A illustrates the ZY cross-section of a portion including the third and the fourth via conductors 13 and 14, which is on a front side in FIG. 12. FIG. 13B illustrates the ZY cross-section of a portion including the first and the second via conductors 11 and 12, which is on a rear side in FIG. 12. A relationship of stack among the respective electrodes in the resonator according to the present configuration example is similar to that of the resonator illustrated in FIG. 1. That is, the respective electrodes are stacked in order of the first ground electrode 31 (FIG. 14A), the second capacitor electrode 42 (FIG. 14B), the first capacitor electrode 41 (FIG. 14C), and the second ground electrode 32 (FIG. 14D), from a top layer of the dielectric block 1.

As in the first via conductor 11, the third via conductor 13 is formed in the dielectric block 1 in the direction orthogonal to the first ground electrode 31 and the second ground electrode 32 (i.e., formed in the direction parallel to a Z-axis in FIG. 12). The third via conductor 13 has a first end which is connected to the first ground electrode 31 and serving as a short-circuit end 13A, and a second end which extends toward the direction in which the second ground electrode 32 is disposed (i.e., extends toward the direction along the bottom surface of the dielectric block 1), and serving as an open end 13B, as in the first via conductor 11.

As in the second via conductor 12, the fourth via conductor 14 is formed in the dielectric block 1 in the direction orthogonal to the first ground electrode 31 and the second ground electrode 32. The fourth via conductor 14 has a first end which is connected to the second ground electrode 32 and serving as a short-circuit end 14A, and a second end which extends toward the direction in which the first ground electrode 31 is disposed (i.e., extends toward the direction along the upper surface of the dielectric block 1), and serving as an open end 14B, as in the second via conductor 12.

The first via conductor 11, the second via conductor 12, the third via conductor 13, and the fourth via conductor 14 are disposed in a square-shaped configuration within a plane parallel to the first ground electrode 31 and the second ground electrode 32. Thereby, each of the adjacent via conductors among the first via conductor 11, the second via conductor 12, the third via conductor 13, and the fourth via conductor 14 is mutually coupled through the interdigital coupling in a cyclical fashion. More specifically, the first via conductor 11 and the second via conductor 12 are coupled to each other through the interdigital coupling, and the second via conductor 12 and the third via conductor 13 are coupled to each other through the interdigital coupling. Further, the third via conductor 13 and the fourth via conductor 14 are coupled to each other through the interdigital coupling, and the forth via conductor 14 and the first via conductor 11 are coupled to each other through the interdigital coupling.

The first capacitor electrode 41 is connected to the open end 11B of the first via conductor 11, and to the open end 13B of the third via conductor 13. The first capacitor electrode 41 is provided with the opening 41A in the region corresponding to the position at which the second via conductor 12 is formed such that the first capacitor electrode 41 is electrically isolated from the second via conductor 12, and another opening 41B in a region corresponding to a position at which the fourth via conductor 14 is formed such that the first capacitor electrode 41 is electrically isolated from the fourth via conductor 14.

The second capacitor electrode 42 is connected to the open end 12B of the second via conductor 12, and to the open end 14B of the fourth via conductor 14. The second capacitor electrode 42 is provided with the opening 42A in the region corresponding to the position at which the first via conductor 11 is formed such that the second capacitor electrode 42 is electrically isolated from the first via conductor 11, and another opening 42B in a region corresponding to a position at which the third via conductor 13 is formed such that the second capacitor electrode 42 is electrically isolated from the third via conductor 13.

Second Configuration Example of Second Embodiment

Figure 15:
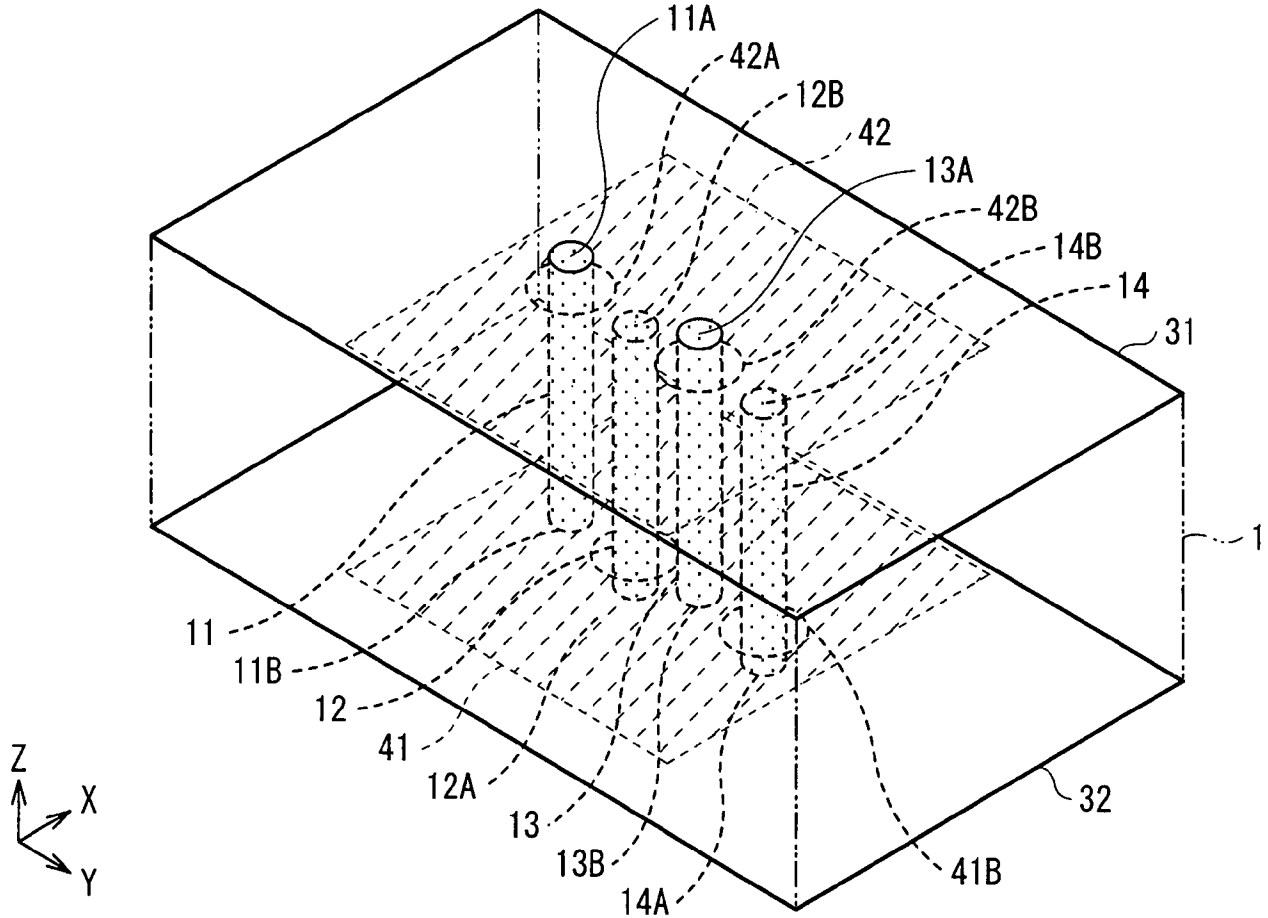
FIG. 15 is a perspective view illustrating a second configuration example of the resonator according to the second embodiment of the invention.
Figure 16:
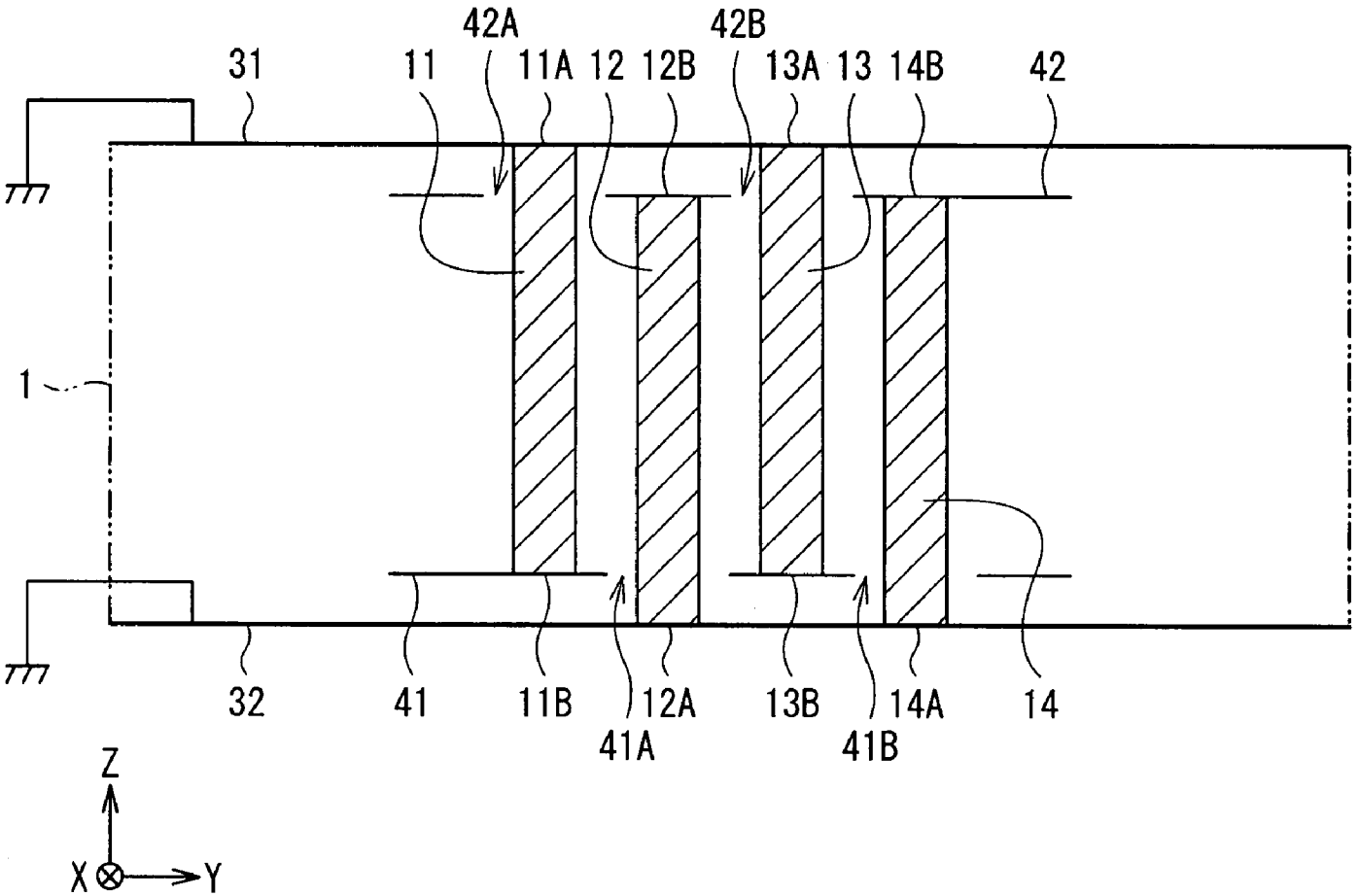
FIG. 16 is a cross-sectional view taken along a side of the resonator illustrated in FIG. 15.
Figure 17A:
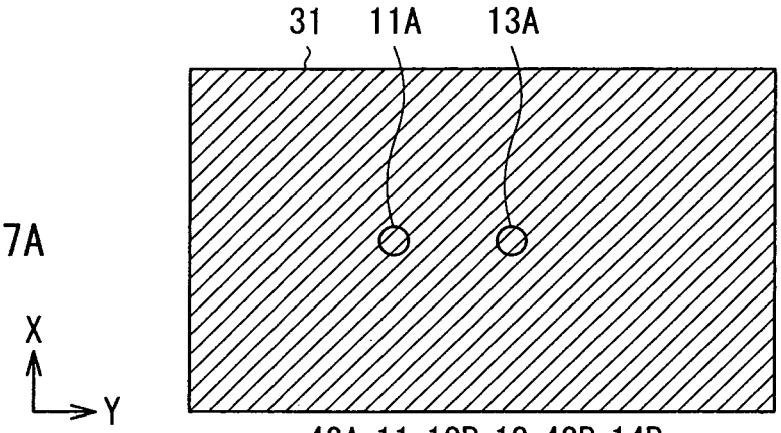
FIG. 17A to FIG. 17D are cross-sectional views taken in a plane of the resonator illustrated in FIG. 15, respectively.
Figure 17B:
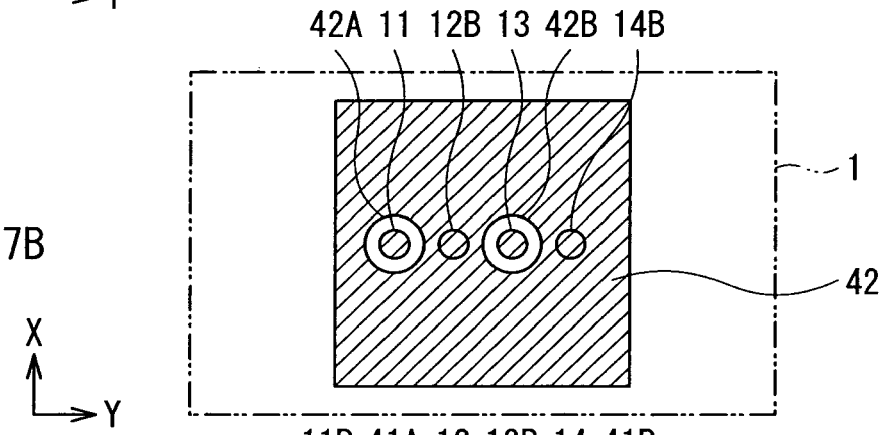
Figure 17C:
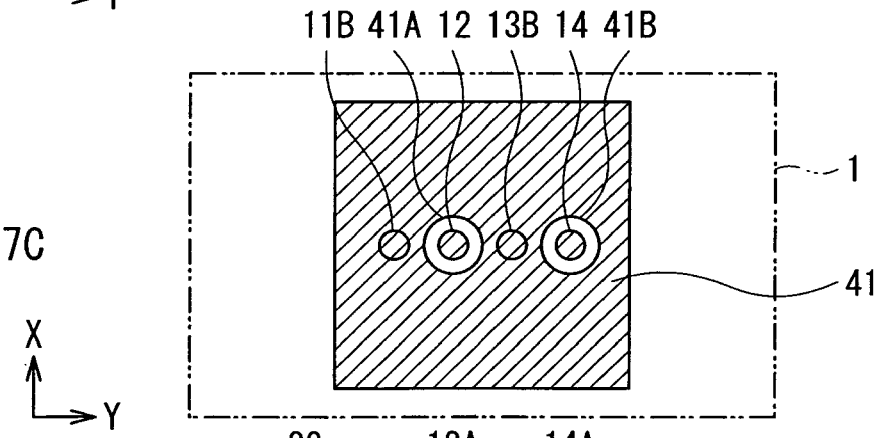
Figure 17D:
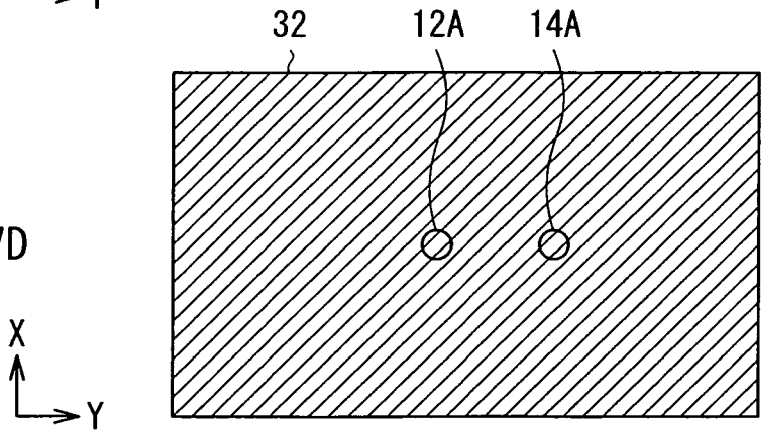

FIG. 15 illustrates a second configuration example of the resonator according to the present embodiment. FIG. 16 illustrates a cross-section taken along a side of the resonator illustrated in FIG. 15 (i.e., the cross-section taken along a ZY-plane and seen from an X-axis direction in FIG. 15). FIG. 17A to FIG. 17D illustrate cross-sections taken along a plane of the resonator illustrated in FIG. 15 (the cross-sections taken along a XY-plane and seen from above in FIG. 15), respectively.

In the second configuration example, the first via conductor 11, the second via conductor 12, the third via conductor 13, and the fourth via conductor 14 are disposed linearly within the plane parallel to the first ground electrode 31 and the second ground electrode 32. Thereby, each of the adjacent via conductors among the first via conductor 11, the second via conductor 12, the third via conductor 13, and the fourth via conductor 14 is mutually coupled through the interdigital coupling. More specifically, the first via conductor 11 and the second via conductor 12 are coupled to each other through the interdigital coupling, the second via conductor 12 and the third via conductor 13 are coupled to each other through the interdigital coupling, and the third via conductor 13 and the fourth via conductor 14 are coupled to each other through the interdigital coupling.

The second configuration example is similar to the first configuration example illustrated in FIG. 12 in terms of the basic configuration of the resonator, except that the via conductors are arranged in the linear fashion.

Examples

Hereinafter, a configuration and its characteristics of a resonator according to an Example of the embodiments of the invention will be described. Also, a configuration and its characteristics of a filter according to an Example, which uses the resonator according to the embodiments of the invention, will be described below.

[Example of Resonator]

Figure 18:
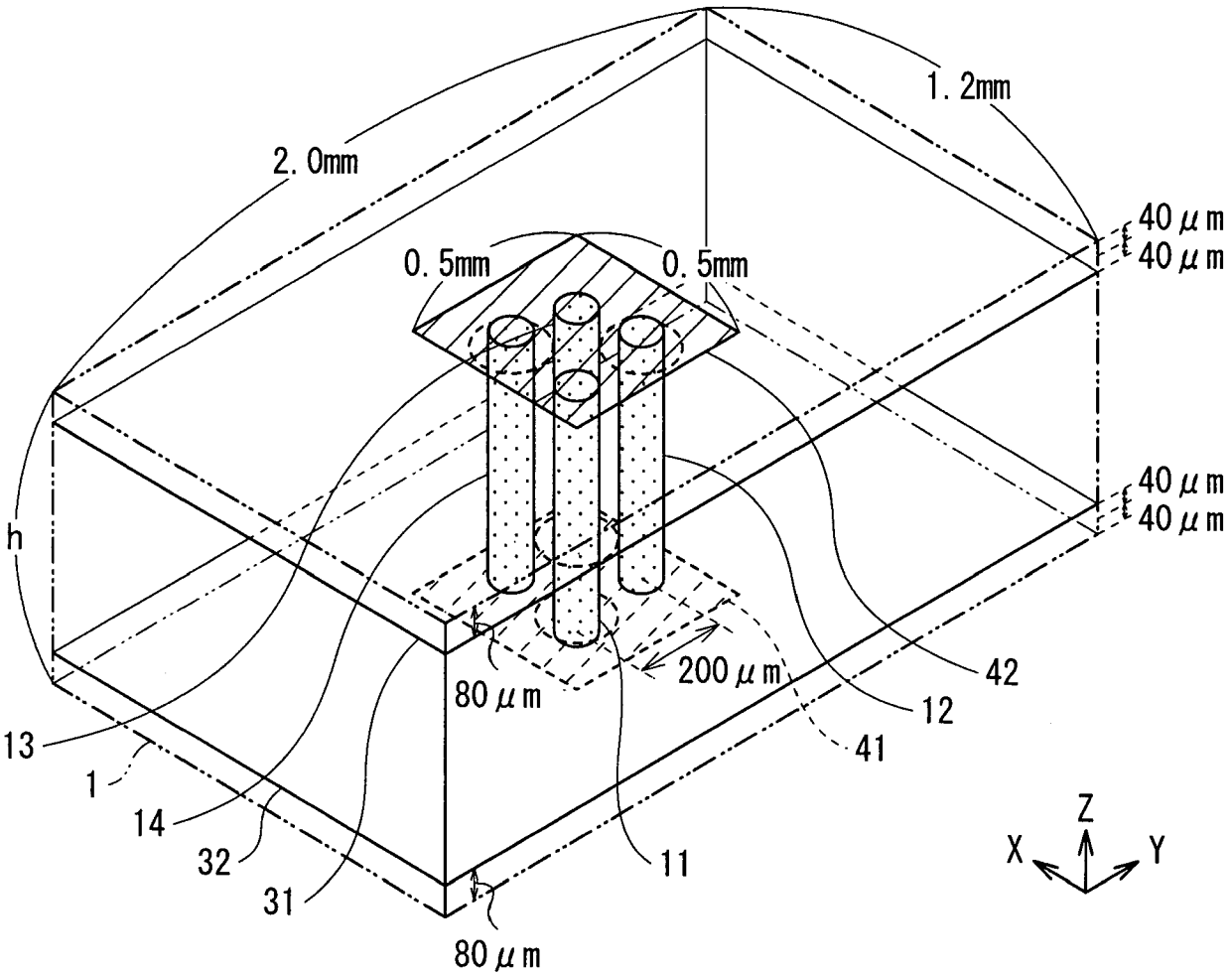
FIG. 18 is a perspective view illustrating an Example of the resonator according to the embodiments of the invention.
Figure 19:
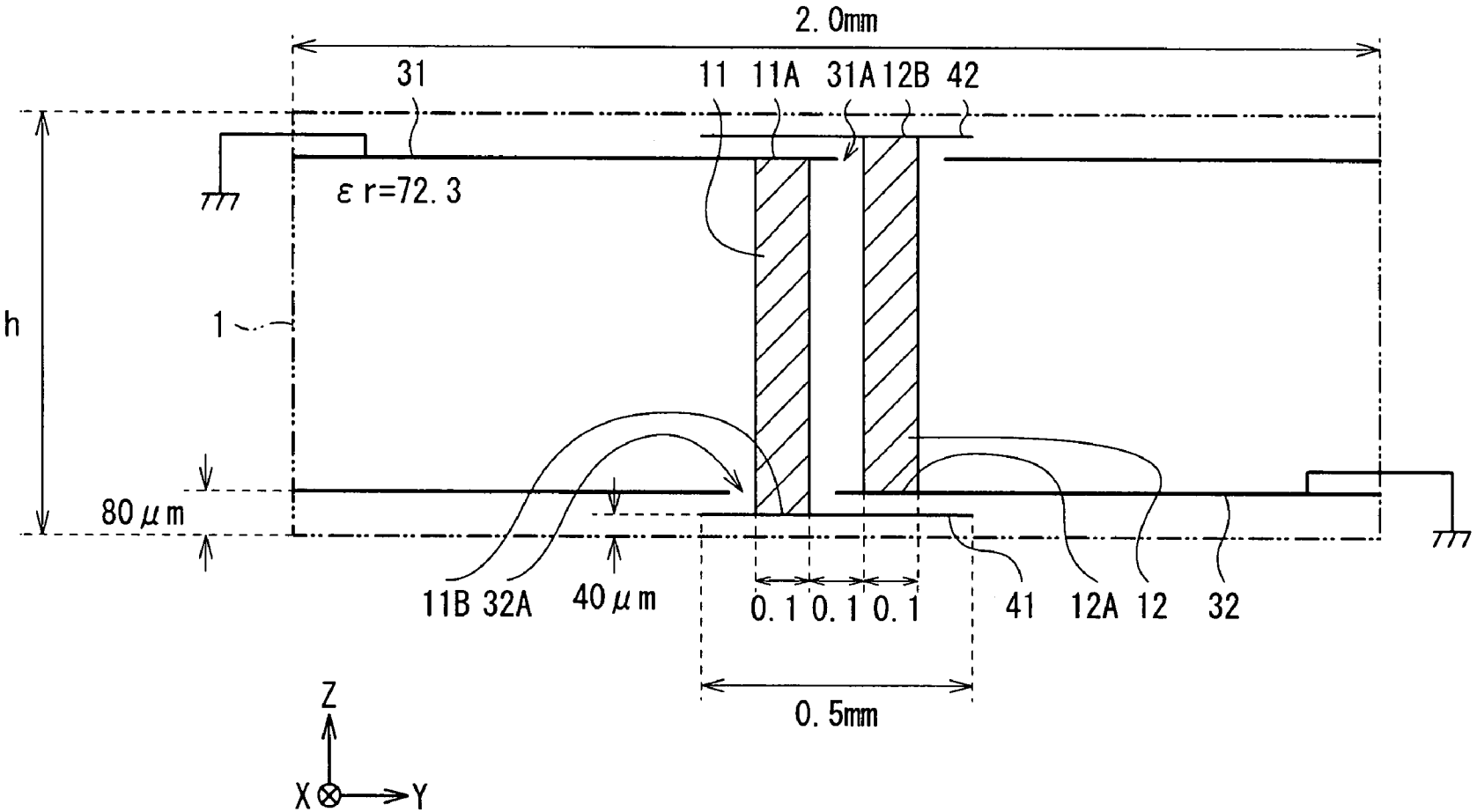
FIG. 19 is a cross-sectional view taken along a side of the resonator illustrated in FIG. 18.
Figure 20A:
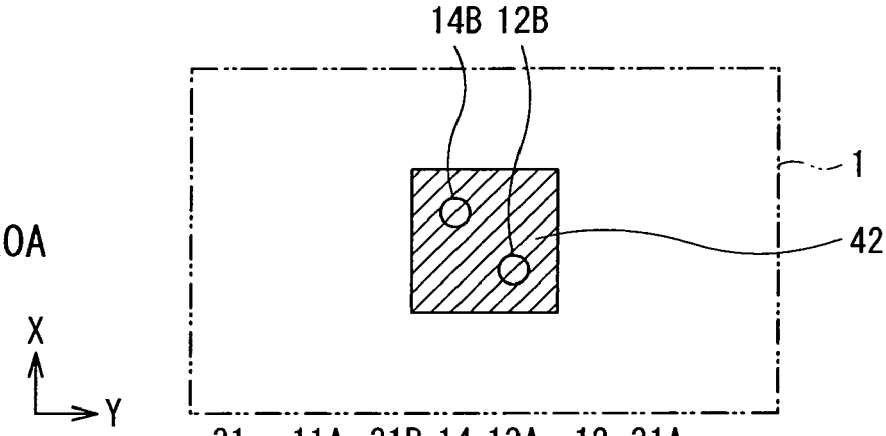
FIG. 20A to FIG. 20D are cross-sectional views taken in a plane of the resonator illustrated in FIG. 18, respectively.
Figure 20B:
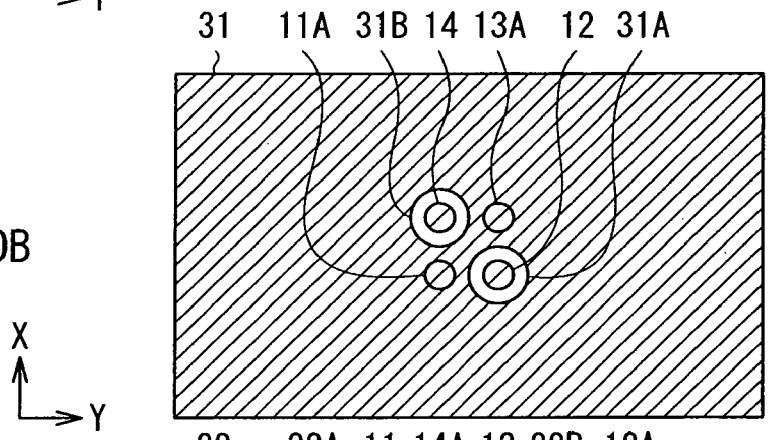
Figure 20C:
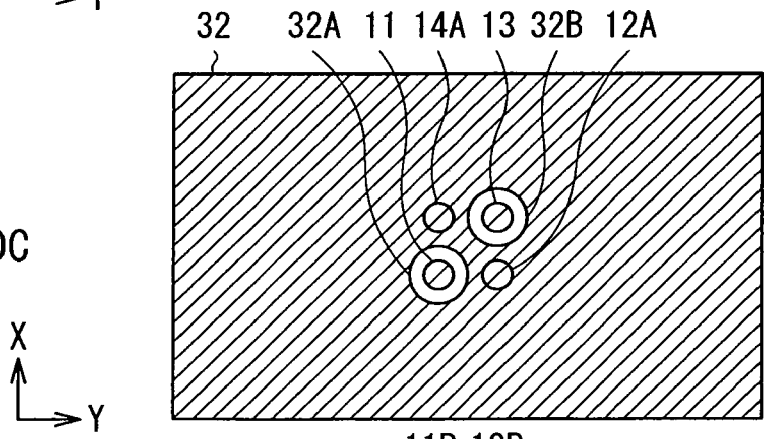
Figure 20D:
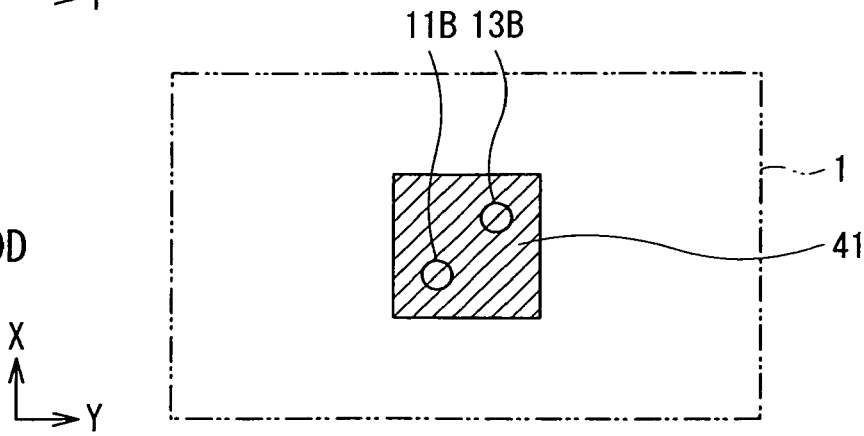

FIG. 18 illustrates the configuration of the resonator according to the present Example. FIG. 19 illustrates a cross-section taken along a side of the resonator illustrated in FIG. 18 (i.e., the cross-section taken along a ZY-plane and seen from an X-axis direction in FIG. 18). FIG. 20A to FIG. 20D illustrate cross-sections taken along a plane of the resonator illustrated in FIG. 18 (the cross-sections taken along a XY-plane and seen from above in FIG. 18), respectively. FIG. 18 and FIG. 19 also indicate the sizes of the main parts of this resonator.

As in the configuration example illustrated in FIG. 12, the resonator according to the present Example was provided with the first via conductor 11, the second via conductor 12, the third via conductor 13, and the fourth via conductor 14, which were disposed in the square-shaped configuration within the plane parallel to the first ground electrode 31 and the second ground electrode 32. However, the present Example differs from the configuration example illustrated in FIG. 12, in that an order of stack of the respective electrodes is altered. A relationship of stack among the respective electrodes in the resonator according to the present Example is similar to that of the resonator illustrated in FIG. 5. That is, the respective electrodes were stacked in order of the second capacitor electrode 42 (FIG. 20A), the first ground electrode 31 (FIG. 20B), the second ground electrode 32 (FIG. 20C), and the first capacitor electrode 41 (FIG. 20D), from a top layer of the dielectric block 1.

The first ground electrode 31 was provided with the opening 31A in the region corresponding to the position at which the second via conductor 12 was formed such that the first ground electrode 31 was electrically isolated from the second via conductor 12, and another opening 31B in the region corresponding to the position at which the fourth via conductor 14 was formed such that the first ground electrode 31 was electrically isolated from the fourth via conductor 14. The second ground electrode 32 was provided with the opening 32A in the region corresponding to the position at which the first via conductor 11 was formed such that the second ground electrode 32 was electrically isolated from the first via conductor 11, and another opening 32B in the region corresponding to the position at which the third via conductor 13 was formed such that the second ground electrode 32 was electrically isolated from the third via conductor 13.

As illustrated in FIGS. 18 and 19 in which the sizes are represented, the dielectric block 1 of the resonator had a planar configuration in which a length in a longitudinal direction was 2.0 mm and a length in a short-side direction (i.e., the direction orthogonal to the longitudinal direction) was 1.2 mm. A relative permittivity $\in r$ of the dielectric block 1 was 72.3. A diameter of a hole of each of the first via conductor 11, the second via conductor 12, the third via conductor 13, and the fourth via conductor 14 was 100 μm (0.1 mm). A via conductor interval (a center distance between the holes of the adjacent via conductors) was 200 μm. Each of the first capacitor electrode 41 and the second capacitor electrode 42 had a planar configuration, which was square in shape and 0.5 mm on a side. The first ground electrode 31 was formed 80 μm below the top surface of the dielectric block 1. A distance in a direction of stack between the second capacitor electrode 42 and the first ground electrode 31 was 40 μm. The second ground electrode 32 was formed 80 μm above the bottom surface of the dielectric block 1. A distance in the stack direction between the first capacitor electrode 41 and the second ground electrode 32 was 40 μm.

A "Q" value (no-load Q) of cases where a height "h" of the resonator as a whole was varied was simulated for the resonator having the configuration described above. Results of the simulation are as represented in Table 1. The Table 1 also represents a Q value when the resonance frequency is set at 2.4 GHz. As can be seen from the results, the Q values having no practical issue were obtained from the height "h" between about 0.3 mm and about 0.4 mm. In other words, the resonator according to the present Example makes it possible to reduce a thickness from about 0.3 mm to about 0.4 mm in height.

TABLE 1

| Via conductor Diameter (μm) | Via conductor Interval (μm) | Resonator Height h (mm) | Frequency (GHz) | Q Value | Q Value (in 2.4 GHz) |
|---|---|---|---|---|---|
| 100 | 200 | 0.8 | 1.580493 | 90.521351 | 111.5476454 |
| 100 | 200 | 0.7 | 1.699555 | 90.256954 | 107.2552824 |
| 100 | 200 | 0.6 | 1.849715 | 89.417945 | 101.8539605 |
| 100 | 200 | 0.5 | 2.039019 | 87.660231 | 95.10375095 |
| 100 | 200 | 0.4 | 2.289609 | 84.149648 | 86.15435273 |
| 100 | 200 | 0.3 | 2.648542 | 77.928481 | 74.1819732 |

Example of Comparative Example

Figure 21:
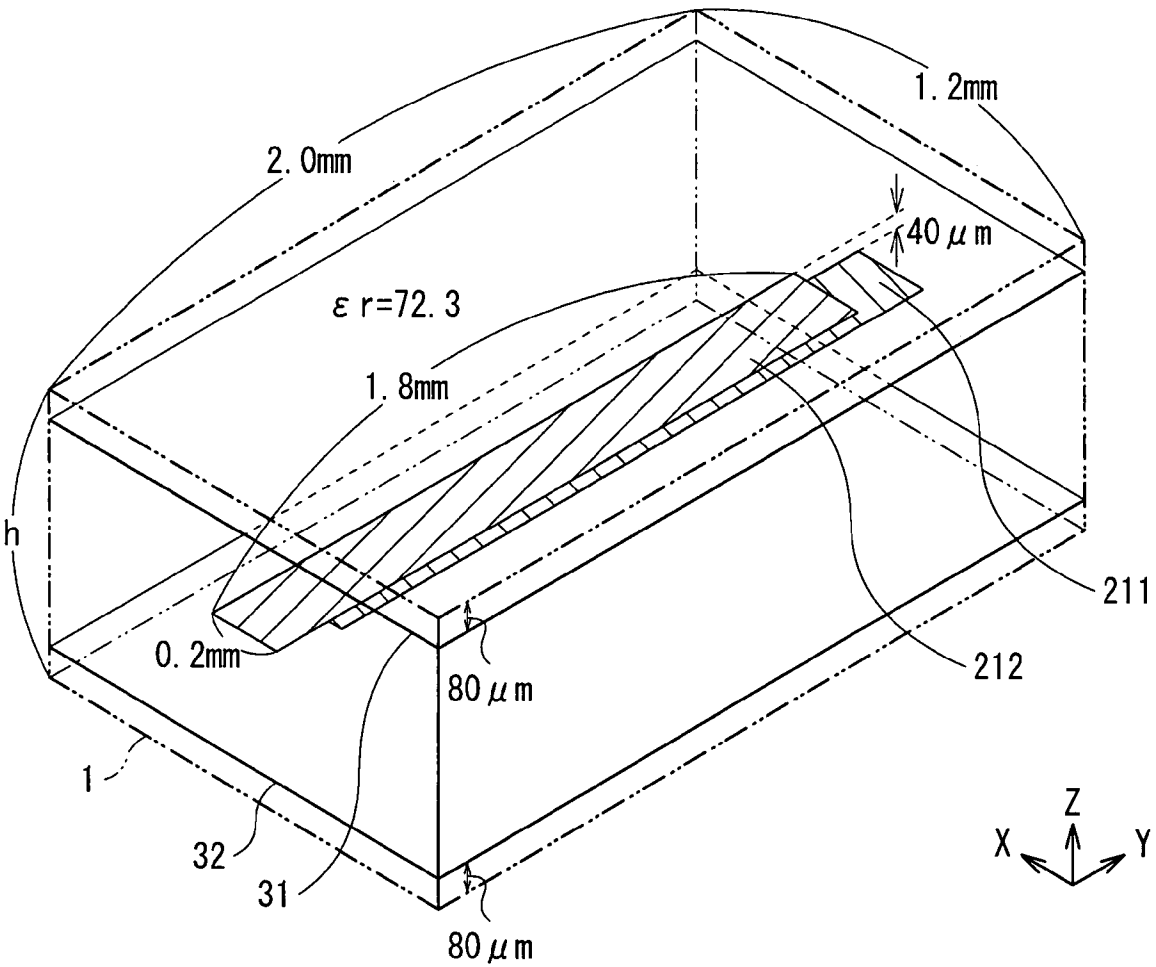
FIG. 21 is a perspective view illustrating a configuration of a resonator according to a comparative example.
Figure 22:
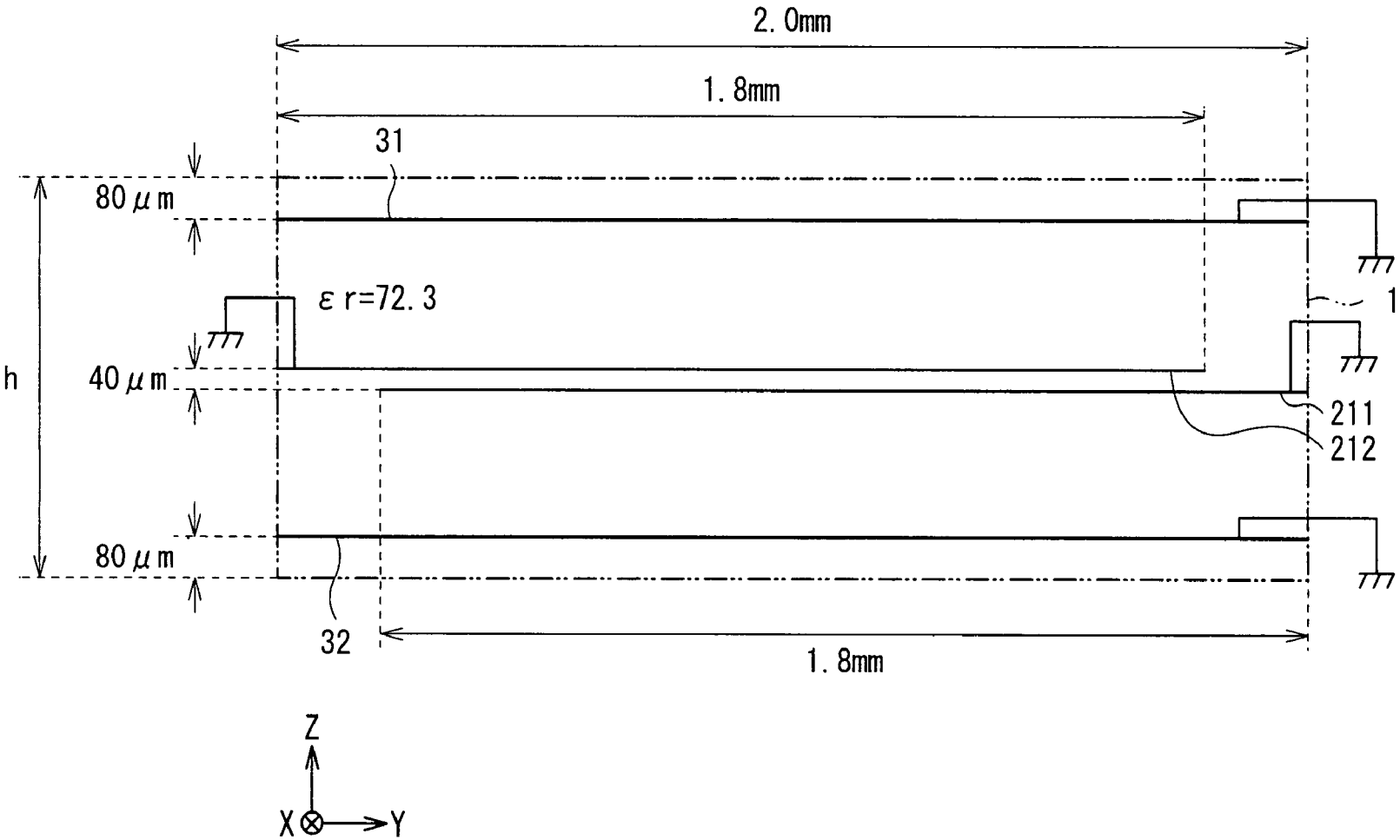
FIG. 22 is a cross-sectional view taken along a side of the resonator according to the comparative example illustrated in FIG. 21.
Figure 23A:
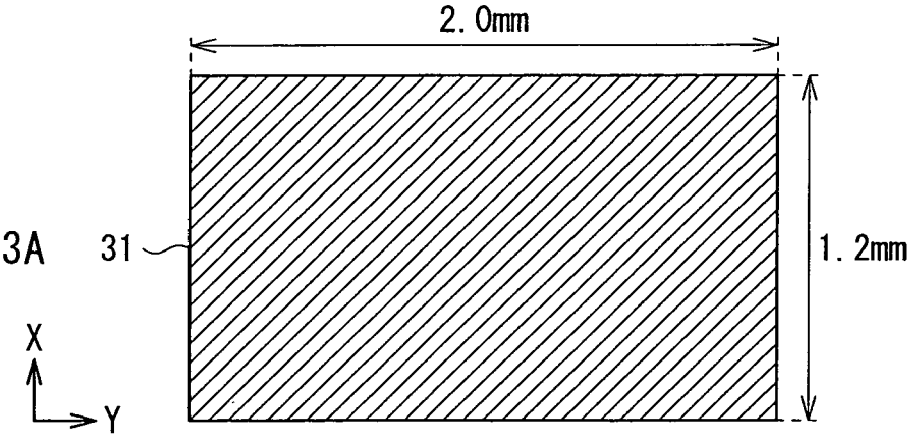
Figure 23B:
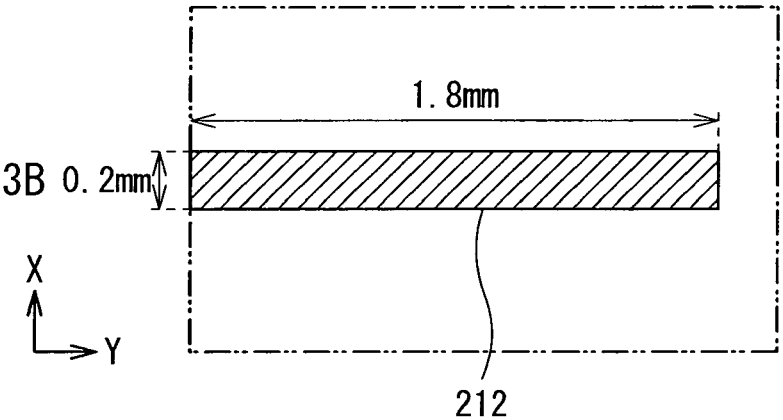
Figure 23C:
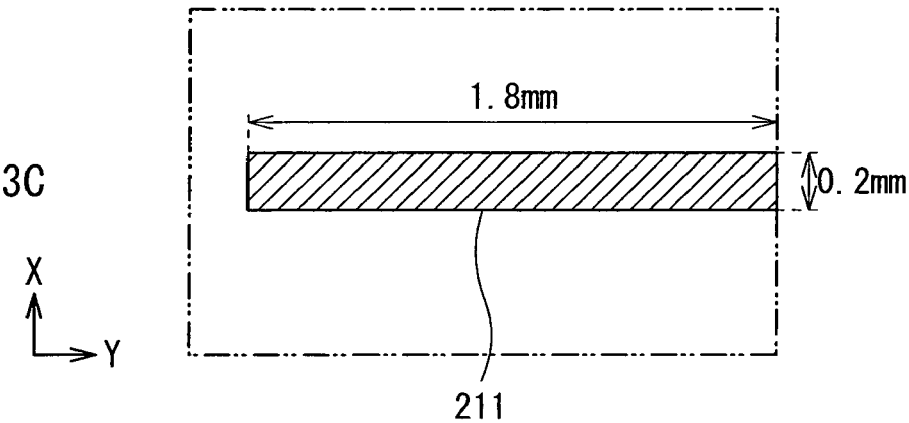
Figure 23D:
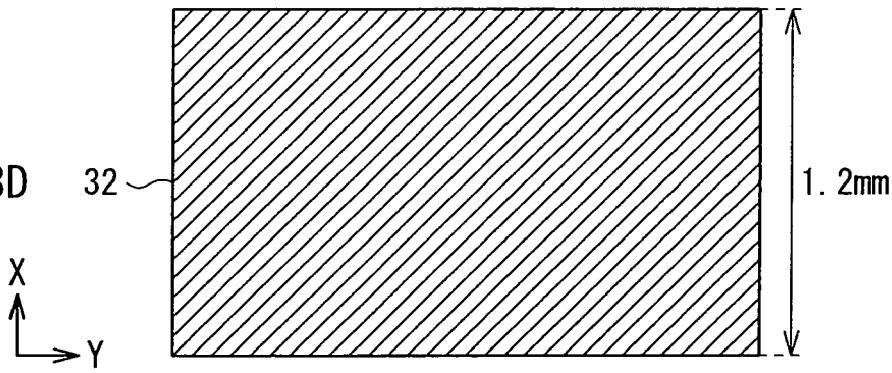

FIG. 21 illustrates a configuration of a resonator according to a comparative example, which will be compared with the Example described above. FIG. 22 illustrates a cross-section taken along a side of the resonator illustrated in FIG. 21 (i.e., the cross-section taken along a ZY-plane and seen from an X-axis direction in FIG. 21). FIG. 23A to FIG. 23D illustrate cross-sections taken along a plane of the resonator illustrated in FIG. 21 (the cross-sections taken along a XY-plane and seen from above in FIG. 21), respectively.

In the resonator according to the comparative example, the electrodes for resonance were structured with conductor patterns having a line configuration, instead of the via conductors, as compared with the resonator according to the Example described above. That is, the resonator according to the comparative example was provided with a first resonance electrode 211 and a second resonance electrode 212 in the dielectric block 1 as the electrodes for resonance, which were coupled through the interdigital coupling in a direction of stack. In this resonator, the respective electrodes were stacked in order of the first ground electrode 31 (FIG. 23A), the second resonance electrode 212 (FIG. 23B), the first resonance electrode 211 (FIG. 23C), and the second ground electrode 32 (FIG. 23D), from a top layer of the dielectric block 1.

As illustrated in FIGS. 21 to 23D in which sizes are represented, each of the first resonance electrode 211 and the second resonance electrode 212 had a width of 0.2 mm and a length of 1.8 mm. A distance between laminates of the first resonance electrode 211 and the second resonance electrode 212 was 40 μm. A configuration of the dielectric block 1 was similar to that of the Example illustrated in FIG. 18, i.e., a length in the longitudinal direction was 2.0 mm and a length in the short-side direction was 1.2 mm. A relative permittivity $\in r$ of the dielectric block 1 was 72.3. The first ground electrode 31 was formed 80 μm below the top surface of the dielectric block 1. The second ground electrode 32 was formed 80 μm above the bottom surface of the dielectric block 1.

A "Q" value (no-load Q) of cases where a height "h" of the resonator as a whole was varied was simulated for the resonator having the configuration described above. Results of the simulation are as represented in Table 2. The Table 2 also represents a Q value when the resonance frequency is at 2.4 GHz. As can be seen from the results in the Tables 1 and 2, the Q values for respective height h were less than those of the characteristics according to the resonator of the above-described Example represented in the Table 1. In other words, it is difficult to reduce a thickness in the configuration of the resonator according to the comparative example, as compared with the resonator of the Example described above.

TABLE 2

| Resonator Height h (mm) | Frequency (GHz) | Q value | Q value (in 2.4 GHz) |
|---|---|---|---|
| 0.3 | 3.14798 | 17.6068 | 15.37340504 |
| 0.4 | 2.67678 | 25.2933 | 23.94995913 |
| 0.5 | 2.42272 | 30.5428 | 30.39924916 |
| 0.6 | 2.26013 | 34.222 | 35.26503326 |
| 0.7 | 2.14741 | 36.9983 | 39.11379046 |
| 0.8 | 2.06641 | 39.686 | 42.76955203 |

[Example of Filter]

Figure 24:
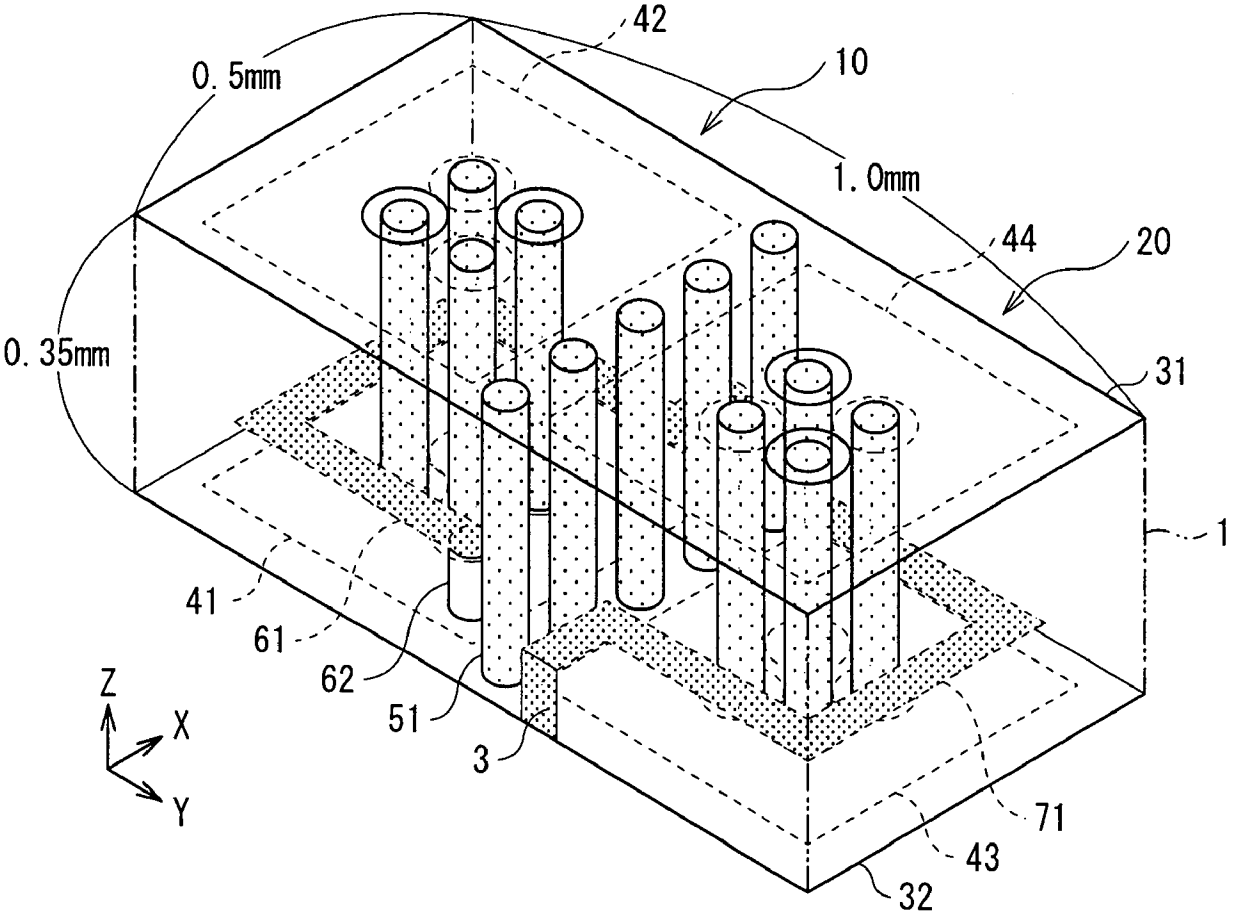
Figure 25A:
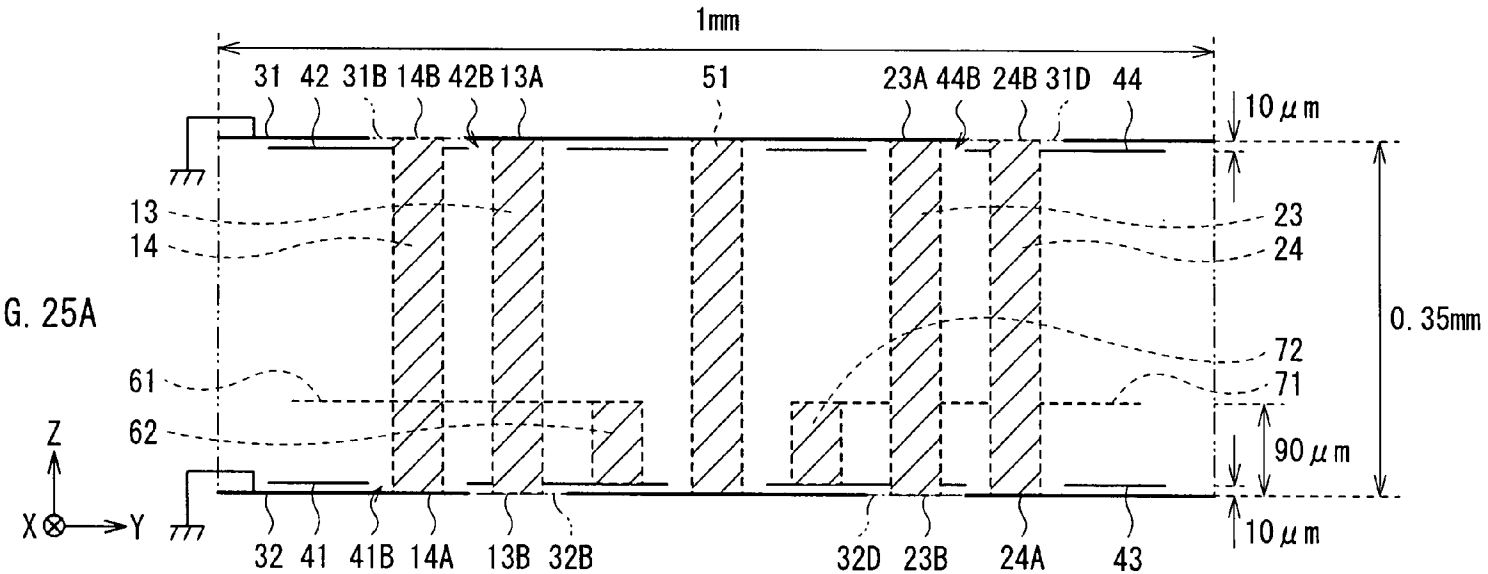
FIG. 25A and FIG. 25B are cross-sectional views taken along a side of the filter illustrated in FIG. 24, respectively.
Figure 25B:
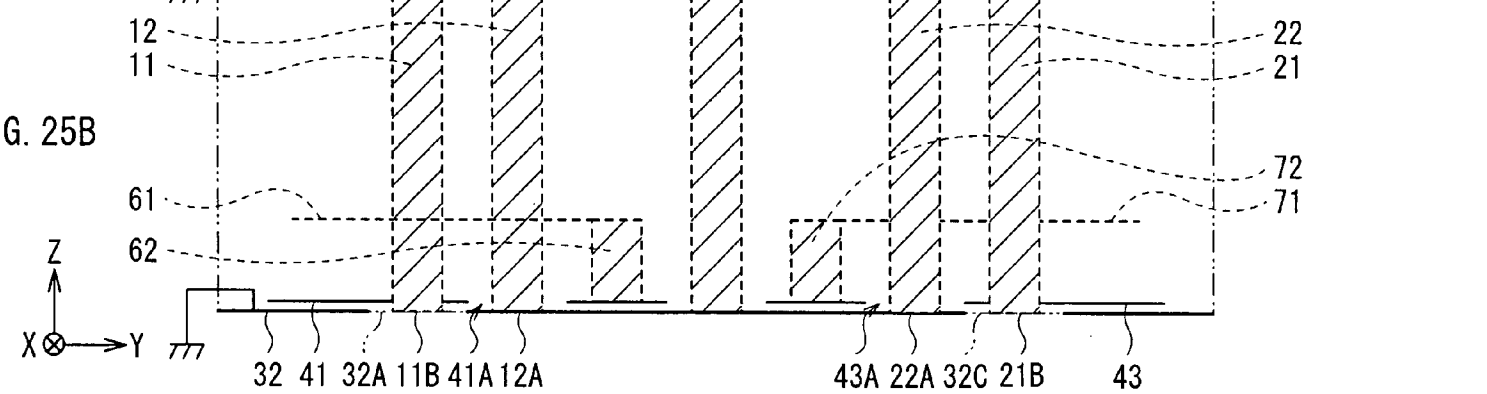
Figure 26A:
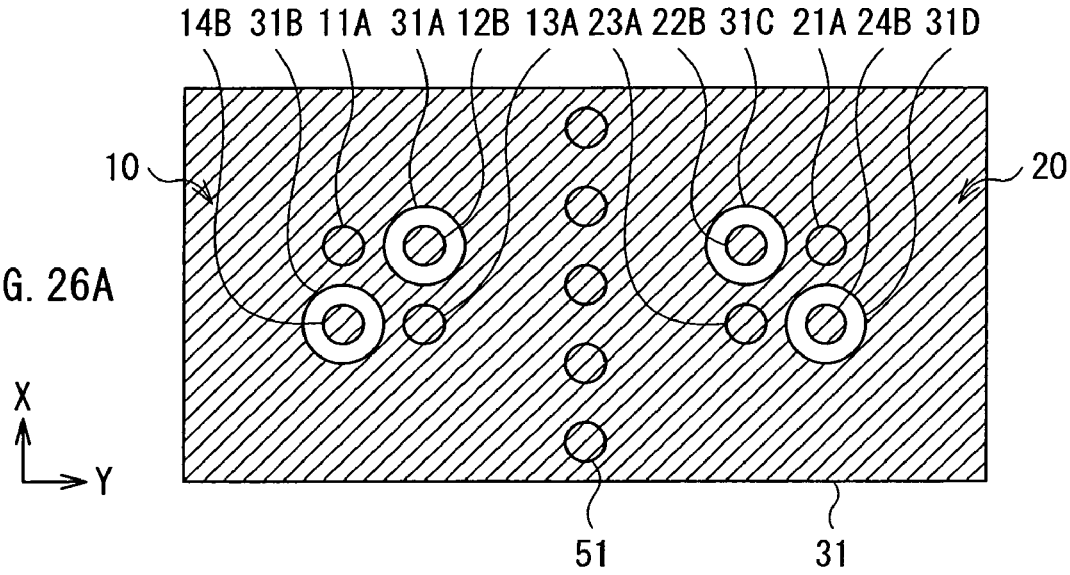
FIGS. 26A and 26B are cross-sectional views taken in a plane of an upper part of the filter illustrated in FIG. 24, respectively.
Figure 26B:
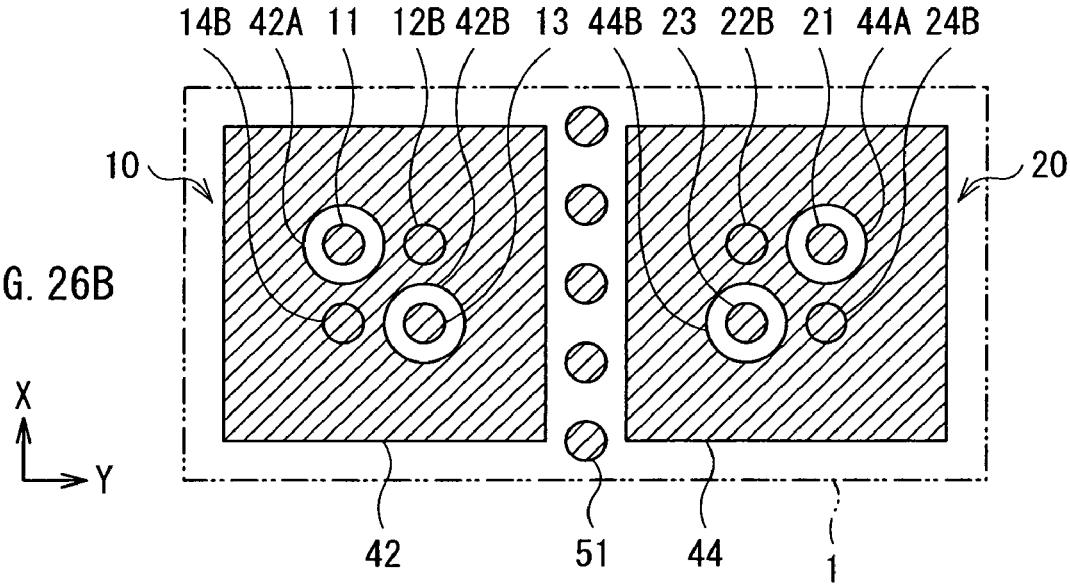
Figure 27A:
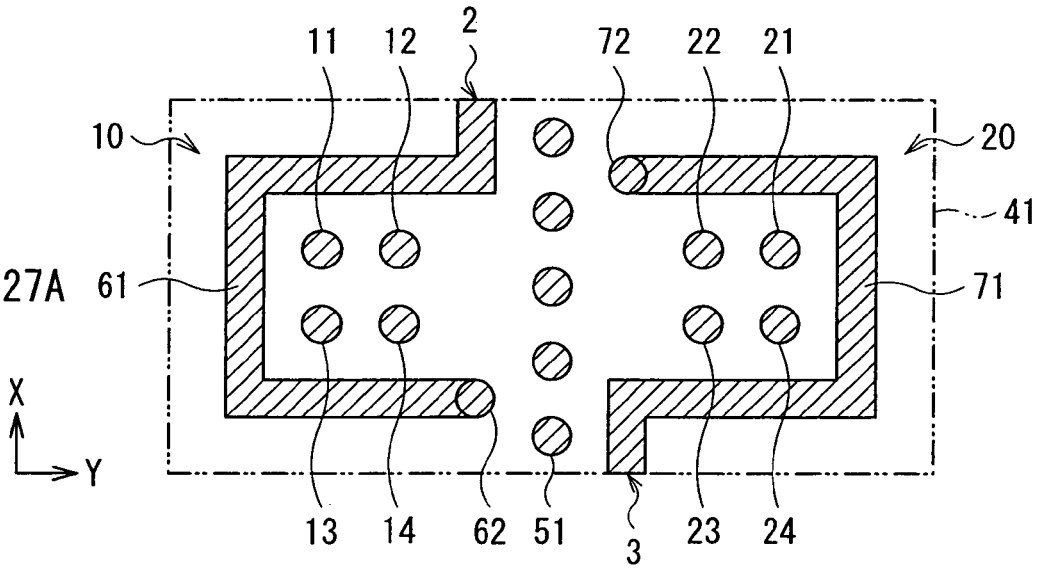
FIG. 27A to FIG. 27C are cross-sectional views taken in the plane of a lower part of the filter illustrated in FIG. 24, respectively.
Figure 27B:
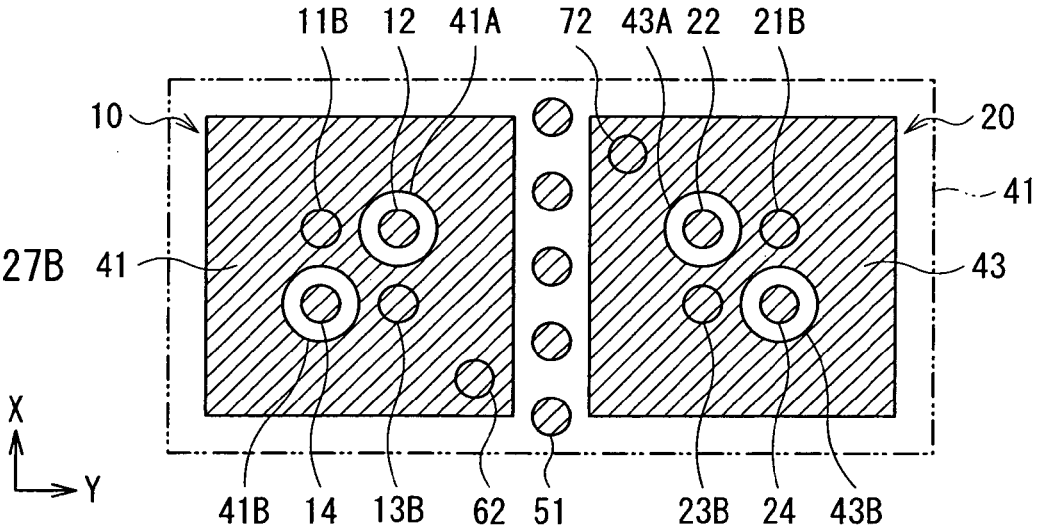
Figure 27C:
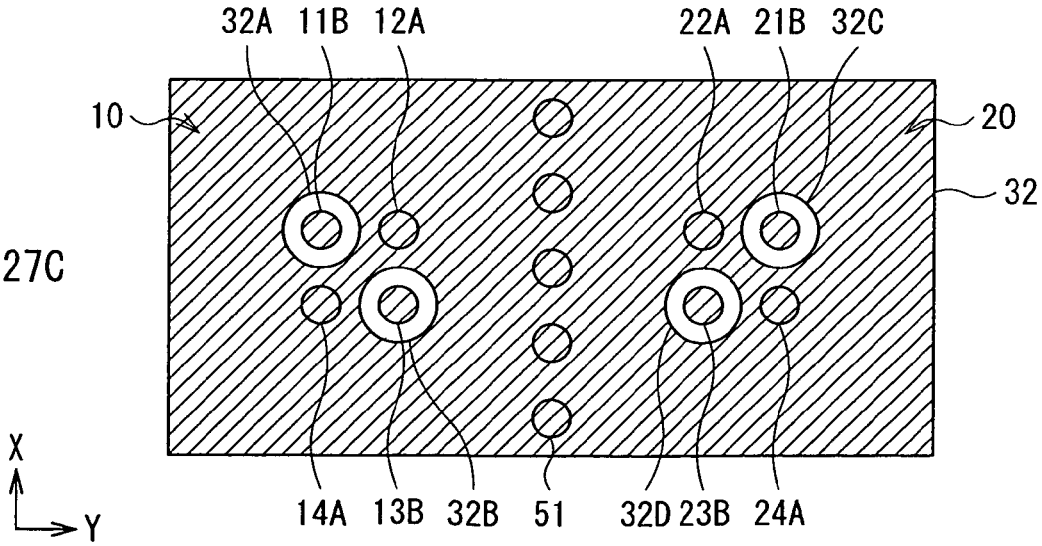

FIG. 24 illustrates a configuration of the filter according to the present Example. FIG. 25A and FIG. 25B illustrate cross-sections taken along a side of the resonator illustrated in FIG. 24, respectively (i.e., the cross-section taken along a ZY-plane and seen from an X-axis direction in FIG. 24). FIG. 26A to FIG. 27C illustrate cross-sections taken along a plane of the resonator illustrated in FIG. 24 (the cross-sections taken along a XY-plane and seen from above in FIG. 24), respectively. More specifically, FIGS. 26A and 26B illustrate respectively a cross-section of a portion including electrodes on an upper-layer side of the filter, whereas FIGS. 27A to 27C illustrate respectively a cross-section of a portion including the electrodes on a lower-layer side of the filter.

The filter was provided with a first resonator 10 and a second resonator 20, which were formed in the dielectric block 1 and so disposed in parallel to each other that the first and the second resonators 10 and 20 were electromagnetically coupled to each other. Each of the first resonator 10 and the second resonator 20 had the pair of quarter wavelength resonators which were coupled through the interdigital coupling. The second resonance frequency $f_2$ being lower in frequency in the interdigitally-coupled pairs of quarter wavelength resonators was set as a pass frequency of the filter. In the present Example, the electrodes for resonance in the first resonator 10 and the second resonator 20 were formed by the via conductors.

The first ground electrode 31 in the filter was served as a common ground electrode between the first resonator 10 and the second resonator 20. The second ground electrode 32 was also served as a common electrode between the first resonator 10 and the second resonator 20.

A plurality of coupling adjusting via conductors 51 were provided between the first resonator 10 and the second resonator 20. The coupling adjusting via conductors 51 adjusted the degree of coupling between the first resonator 10 and the second resonator 20. Each of the coupling adjusting via conductors 51 penetrated between the first ground electrode 31 and the second ground electrode 32, and had a first end connected to the first ground electrode 31 and a second end connected to the second ground electrode 32. The providing of the coupling adjusting via conductors 51 made it possible to reduce the size without increasing a distance between the first resonator 10 and the second resonator 20 (i.e., without separating them further away from each other), while weakening the coupling between the first resonator 10 and the second resonator 20. In general, narrow-band filter characteristics are obtained with ease by weakening the coupling between the two resonators.

A basic configuration of the first resonator 10 was similar to that of the resonator illustrated in FIG. 12. That is, the first resonator 10 was provided with the first via conductor 11, the second via conductor 12, the third via conductor 13, and the fourth via conductor 14 as the electrodes for resonance, which were disposed in the square-shaped configuration within the plane parallel to the first ground electrode 31 and the second ground electrode 32.

However, the open end 11B of the first via conductor 11 and the open end 13B of the third via conductor 13 in the first resonator 10 extended to the second ground electrode 32. Thus, the second ground electrode 32 was provided with the opening 32A in the region corresponding to the position at which the first via conductor 11 was formed such that the second ground electrode 32 was electrically isolated from the first via conductor 11, and another opening 32B in the region corresponding to the position at which the third via conductor 13 was formed such that the second ground electrode 32 was electrically isolated from the third via conductor 13.

Similarly, the open end 12B of the second via conductor 12 and the open end 14B of the fourth via conductor 14 extended to the first ground electrode 31. Thus, the first ground electrode 31 was provided with the opening 31A in the region corresponding to the position at which the second via conductor 12 was formed such that the first ground electrode 31 was electrically isolated from the second via conductor 12, and another opening 31B in the region corresponding to the position at which the fourth via conductor 14 was formed such that the first ground electrode 31 was electrically isolated from the fourth via conductor 14.

FIG. 25A illustrates the ZY cross-section of a portion including the third and the fourth via conductors 13 and 14, which is on a front side in FIG. 24. FIG. 25B illustrates the ZY cross-section of a portion including the first and the second via conductors 11 and 12, which is on a rear side in FIG. 24. A relationship of stack among the respective electrodes in the first resonator 10 was similar to that of the resonator illustrated in FIG. 12. That is, the respective electrodes were stacked in order of the first ground electrode 31 (FIG. 26A), the second capacitor electrode 42 (FIG. 26B), the first capacitor electrode 41 (FIG. 27B), and the second ground electrode 32 (FIG. 27C), from a top layer of the dielectric block 1.

The first resonator 10 was further provided with a terminal leader electrode 61 and a terminal leader via conductor 62, which were for allowing connection to the external terminal electrode 2 (FIG. 27A). The external terminal electrode 2 was formed on one side surface of the dielectric block 1 (i.e., the side of the dielectric block 1 on the rear side in the X-direction in FIG. 24), which is hidden and not seen in FIG. 24 for convenience of illustration. The terminal leader electrode 61 was configured with a conductor line pattern, and was formed on the upper layer side relative to the first capacitor electrode 41. The terminal leader via conductor 62 connected the terminal leader electrode 61 and the first capacitor electrode 41, and had a first end electrically connected to the first capacitor electrode 41 and a second end electrically connected to the terminal leader electrode 61.

The second resonator 20 had a configuration which was similar to that of the first resonator 10. That is, the second resonator 20 was provided with a first via conductor 21, a second via conductor 22, a third via conductor 23, and a fourth via conductor 24 as the electrodes for resonance, which were disposed in the square-shaped configuration within the plane parallel to the first ground electrode 31 and the second ground electrode 32.

The second resonator 20 was provided with the first capacitor electrode 43 and the second capacitor electrode 44. The first capacitor electrode 43 was stacked within a plane corresponding to the first capacitor electrode 41 of the first resonator 10 (FIG. 27B). The second capacitor electrode 44 was stacked within a plane corresponding to the second capacitor electrode 42 of the first resonator 10 (FIG. 26B).

The first capacitor electrode 43 was connected to an open end 21B of the first via conductor 21, and to an open end 23B of the third via conductor 23. The first capacitor electrode 43 was provided with the opening 43A in a region corresponding to a position at which the second via conductor 22 was formed such that the first capacitor electrode 43 was electrically isolated from the second via conductor 22, and another opening 43B in a region corresponding to a position at which the fourth via conductor 24 was formed such that the first capacitor electrode 43 was electrically isolated from the fourth via conductor 24.

The second capacitor electrode 44 was connected to an open end 22B of the second via conductor 22, and to an open end 24B of the fourth via conductor 24. The second capacitor electrode 44 was provided with the opening 44A in a region corresponding to a position at which the first via conductor 21 was formed such that the second capacitor electrode 44 was electrically isolated from the first via conductor 21, and another opening 44B in a region corresponding to a position at which the third via conductor 23 was formed such that the second capacitor electrode 44 was electrically isolated from the third via conductor 23.

In the second resonator 20, the open end 21B of the first via conductor 21 and the open end 23B of the third via conductor 23 extended to the second ground electrode 32. Thus, the second ground electrode 32 was provided with an opening 32C in a region corresponding to the position at which the first via conductor 21 was formed such that the second ground electrode 32 was electrically isolated from the first via conductor 21, and another opening 32D in a region corresponding to the position at which the third via conductor 23 was formed such that the second ground electrode 32 was electrically isolated from the third via conductor 23.

Similarly, the open end 22B of the second via conductor 22 and the open end 24B of the fourth via conductor 24 extended to the first ground electrode 31. Thus, the first ground electrode 31 was provided with the opening 31B in a region corresponding to the position at which the second via conductor 22 was formed such that the first ground electrode 31 was electrically isolated from the second via conductor 22, and another opening 31D in a region corresponding to the position at which the fourth via conductor 24 was formed such that the first ground electrode 31 was electrically isolated from the fourth via conductor 24.

The second resonator 20 was further provided with a terminal leader electrode 71 and a terminal leader via conductor 72, which were for allowing connection to an external terminal electrode 3 (FIGS. 24 and 27A). As illustrated in FIG. 24, the external terminal electrode 3 was formed on a side of the dielectric block 1 which is on a front side thereof. The terminal leader electrode 71 was configured with a conductor line pattern, and was formed on the upper layer side relative to the first capacitor electrode 43. The terminal leader via conductor 72 connected the terminal leader electrode 71 and the first capacitor electrode 43, and had a first end electrically connected to the first capacitor electrode 43 and a second end electrically connected to the terminal leader electrode 71.

As illustrated in FIG. 24 in which sizes are represented, the dielectric block 1 of the filter had a planar configuration in which a length in the longitudinal direction was 1.0 mm and a length in the short-side direction was 0.5 mm. A height of the dielectric block 1 was 0.35 mm. A relative permittivity a of the dielectric block 1 was 72.3.

Figure 28:
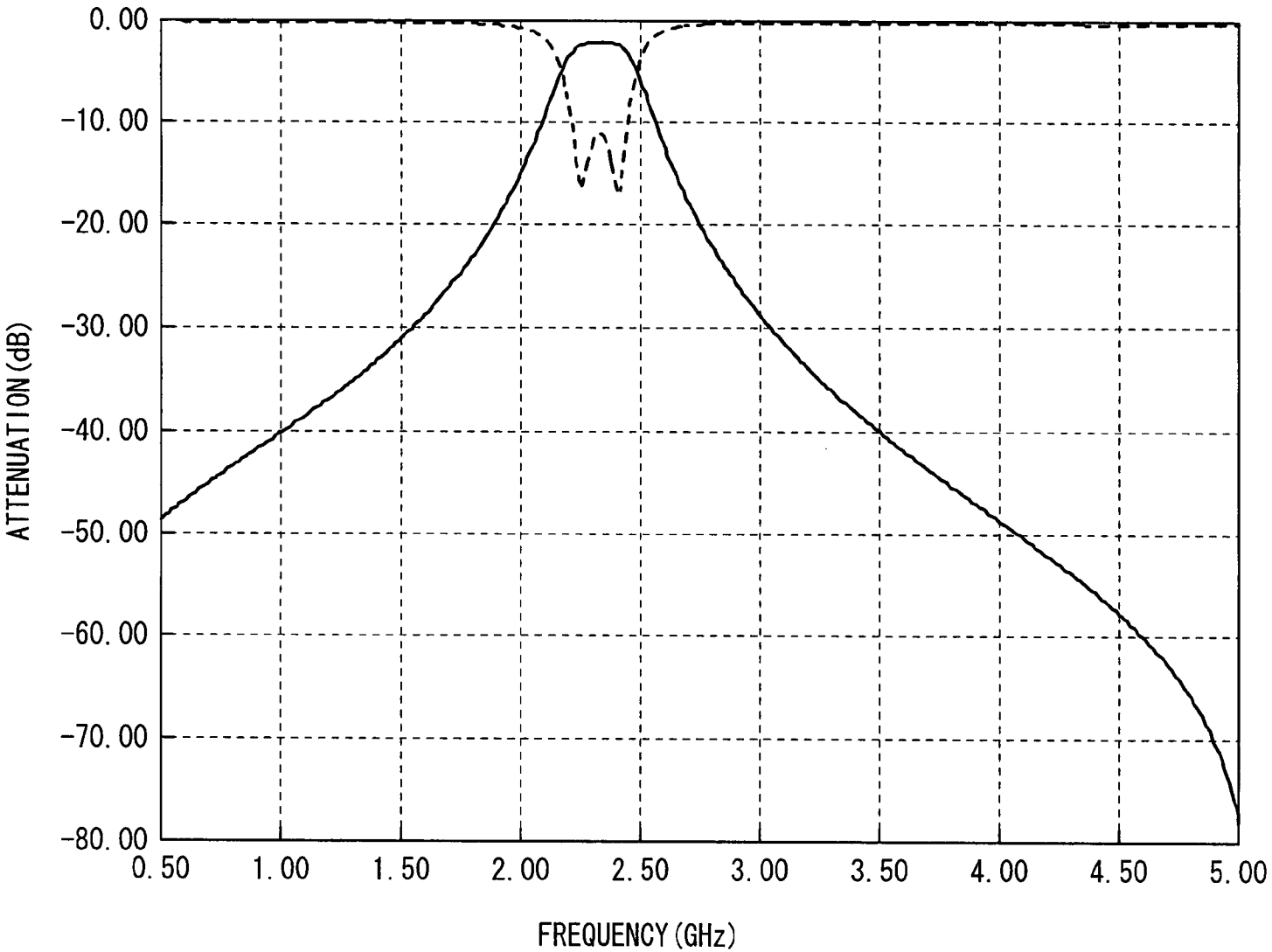
FIG. 28 is a characteristic diagram representing transmission characteristics of the filter illustrated in FIG. 24.
Figure 29:
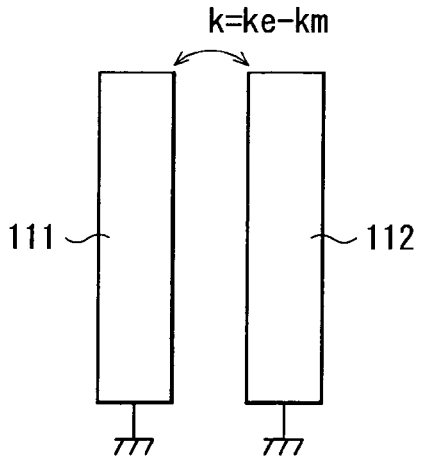
FIG. 29 illustrates a basic configuration of a pair of quarter wavelength resonators which are coupled through a comb-line coupling.
Figure 30:
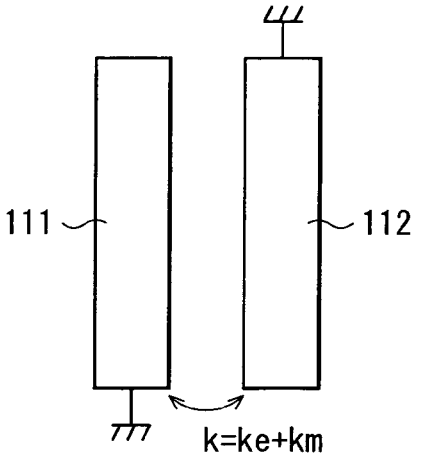
FIG. 30 illustrates a basic configuration of a pair of quarter wavelength resonators which are coupled through an interdigital coupling.
Figure 31:
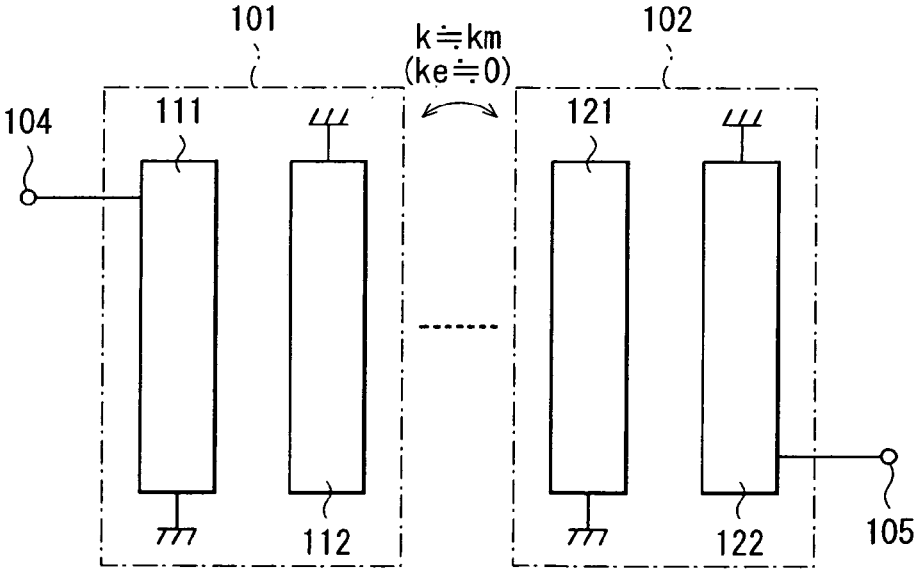
FIG. 31 illustrates a basic configuration of a filter utilizing two pairs of quarter wavelength resonators each of which is coupled through the interdigital coupling.
Figure 32:
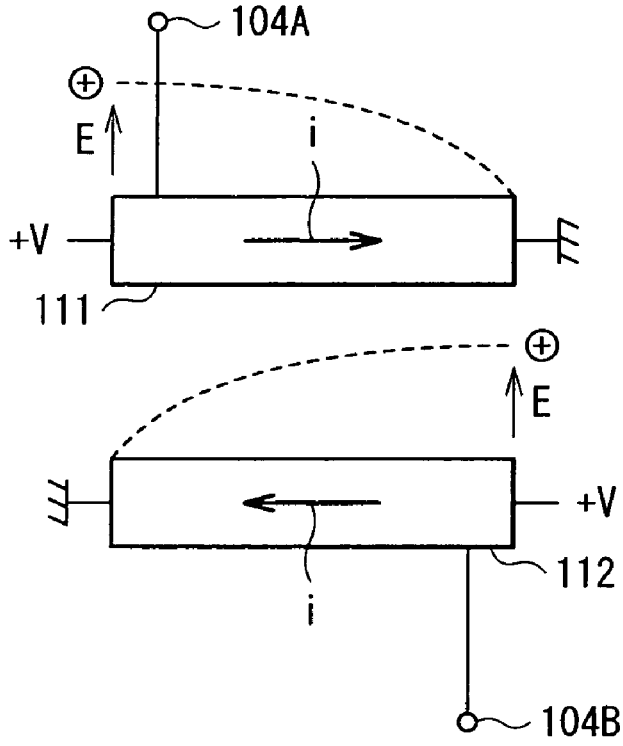
FIG. 32 is an explanatory view illustrating a first resonant mode of the pair of quarter wavelength resonators which are coupled through the interdigital coupling.
Figure 33:
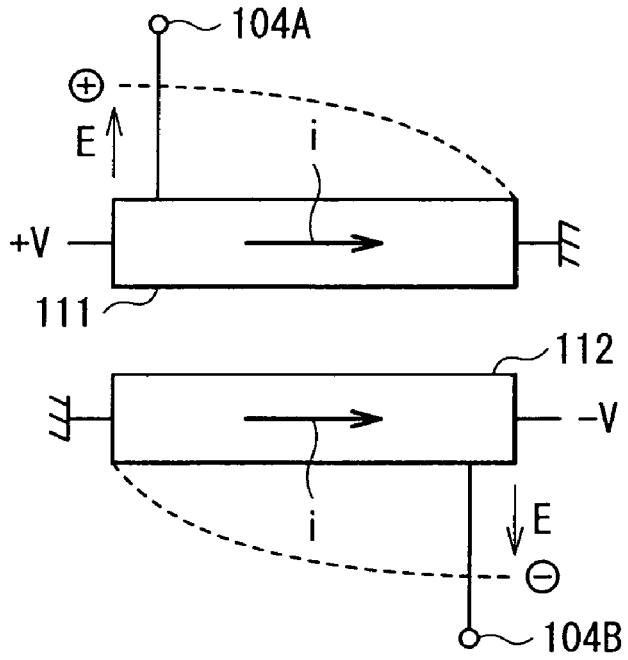
FIG. 33 is an explanatory view illustrating a second resonant mode of the pair of quarter wavelength resonators which are coupled through the interdigital coupling.
Figure 34:
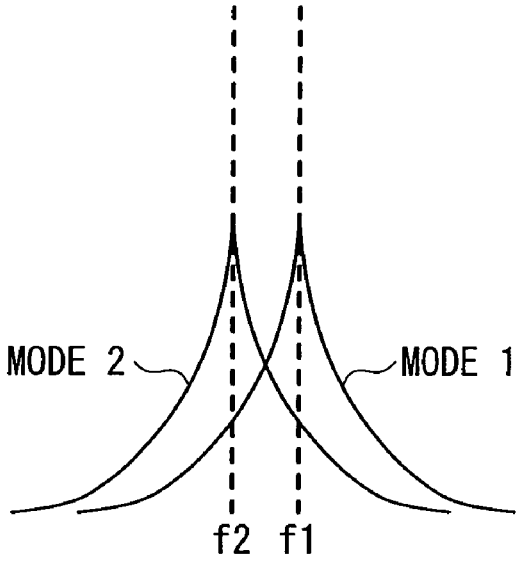
FIG. 34 is an explanatory view illustrating resonant modes of two resonators in which a degree of coupling is weak.
Figure 35:
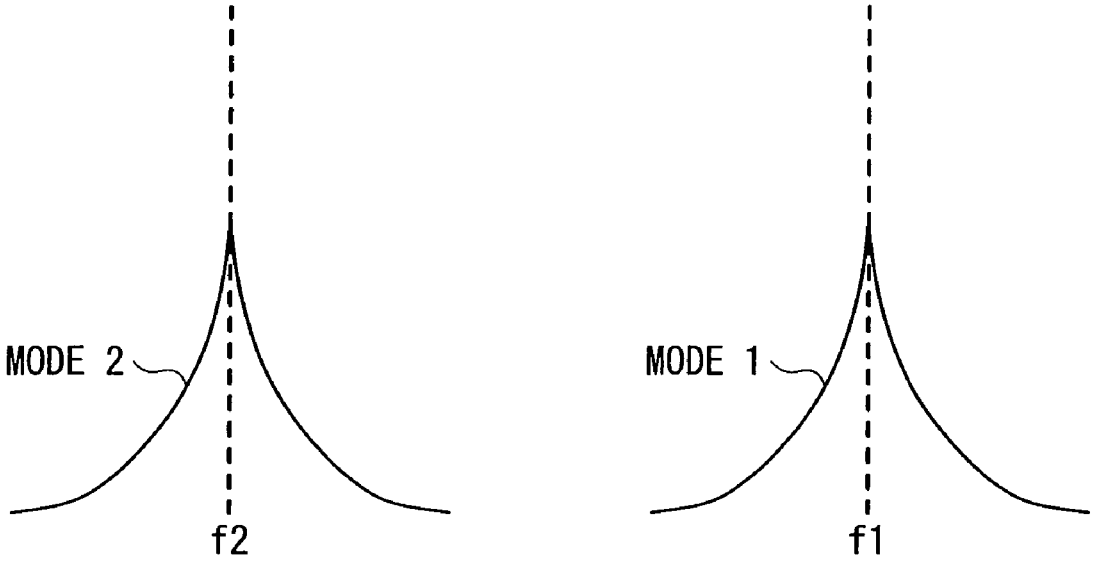
FIG. 35 is an explanatory view illustrating the resonant modes of the two resonators in which the degree of coupling is strong.
Figure 36:
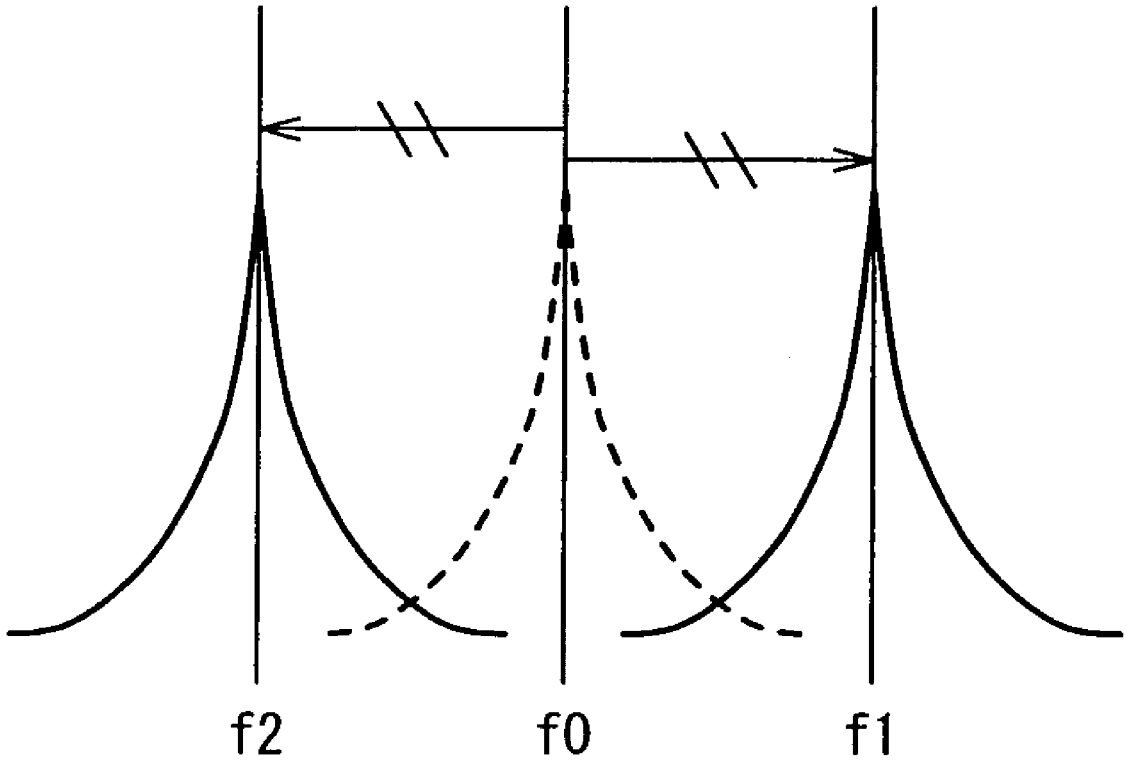
FIG. 36 is an explanatory view illustrating a distribution state of a resonance frequency in the pair of quarter wavelength resonators which are coupled through the interdigital coupling.

An attenuation characteristic and a loss characteristic were simulated for the filter having the configuration described above. Results of the simulation are as represented in FIG. 28, in which a horizontal axis represents frequency and a vertical axis represents attenuation. In FIG. 28, a solid curve represents an insertion loss characteristic of a signal in the filter, whereas a dashed curve represents a reflection loss characteristic as viewed from an input side. As can be seen from FIG. 28, excellent filter characteristics, in which a passband was around 2.4 GHz, were obtained.

Other Embodiments

Although the present invention has been described in the foregoing by way of example with reference to the embodiments and Examples described above, the present invention is not limited thereto, but rather, may be variously modified. For example, the number of via conductors structuring one resonator may not be two or four, i.e., a configuration etc., having six or more via conductors per resonator may be employed. Also, the configuration of the filter is not limited to that illustrated in FIGS. 26A and 26B, i.e., a configuration in which the coupling adjusting via conductor 51 is not provided may be employed, for example. The example in which the coupling adjusting via conductor 51 is not provided makes it possible to achieve the reduction of size while strengthening the coupling between the first resonator 10 and the second resonator 20, and is thus suitable for structuring a broadband bandpass filter. Further, the configuration of each of the first resonator 10 and the second resonator 20 is not limited to the configuration illustrated in FIGS. 26A and 26B, i.e., any configurations of the resonator illustrated in other drawings may be used, for example. Moreover, the unbalanced input-output configuration, in which each of the first resonator 10 and the second resonator 20 has one terminal electrode, has been described with reference to FIGS. 26A and 26B. However, a balanced input-output configuration may be employed, in which the first resonator 10 or the second resonator 20 or both has a pair of terminal electrodes, for example.

The present application is based on and claims priority from Japanese Patent Application No. 2009-081759, filed in the Japan Patent Office on Mar. 30, 2009, the disclosure of which is hereby incorporated by reference herein in its entirety.

Although the present invention has been described in terms of exemplary embodiments, it is not limited thereto. It should be appreciated that variations may be made in the described embodiments by persons skilled in the art without departing from the scope of the present invention as defined by the following claims. The limitations in the claims are to be interpreted broadly based on the language employed in the claims and not limited to examples described in the present specification or during the prosecution of the application, and the examples are to be construed as non-exclusive. For example, in the present disclosure, the term "preferably", "preferred" or the like is non-exclusive and means "preferably", but not limited to. The use of the terms first, second, etc. do not denote any order or importance, but rather the terms first, second, etc. are used to distinguish one element from another. Moreover, no element or component in the present disclosure is intended to be dedicated to the public regardless of whether the element or component is explicitly recited in the following claims.

What is claimed is:

1. A resonator for a bandpass filter, comprising:

a dielectric block;

a first ground electrode and a second ground electrode provided on or in the dielectric block so as to oppose each other;

a first via conductor provided in the dielectric block so as to extend in a direction orthogonal to faces of the first and second ground electrodes, and having a short-circuit end and an open end, the short-circuit end being connected to the first ground electrode, and the open end extending toward the second ground electrode;

a second via conductor provided in the dielectric block so as to extend in the direction orthogonal to faces of the first and second ground electrodes, and having a short-circuit end and an open end, the short-circuit end being connected to the second ground electrode, and the open end extending toward the first ground electrode;

a third via conductor provided in the dielectric block so as to extend in the direction orthogonal to faces of the first and second ground electrodes, and having a short-circuit end and an open end, the short-circuit end being connected to the first ground electrode, and the open end extending toward the second ground electrode;

a fourth via conductor provided in the dielectric block so as to extend in the direction orthogonal to faces of the first and second ground electrodes, and having a short-circuit end and an open end, the short-circuit end being connected to the second ground electrode, and the open end extending toward the first ground electrode, a first capacitor electrode provided in the dielectric block, and connected to the first via conductor and the third via conductor; and a second capacitor electrode provided in the dielectric block, and connected to the second via conductor and the fourth via conductor, wherein every couple of via conductors immediately neighboring one another, selected from the first to fourth via conductors, are interdigitally coupled with each other, the interdigitally coupled via conductors have a first resonant mode resonating at a first resonance frequency $f_1$ which is higher than a resonance frequency $f_0$ determined by a physical length of each via conductors, and a second resonant mode resonating at a second resonance frequency $f_2$ which is lower than the resonance frequency $f_o$ and an operating frequency is set at the resonance frequency $f_2$.

2. The resonator according to claim 1, wherein the first capacitor electrode is connected to the open end of the first via conductor and the open end of the third via conductor, and is so disposed to oppose the second ground electrode that a first capacitor is formed with the first capacitor electrode and the second ground electrode, and the second capacitor electrode is connected to the open end of the second via conductor and the open end of the fourth via conductor, and is so disposed to oppose the first ground electrode that a second capacitor is formed with the second capacitor electrode and the first ground electrode.

3. The resonator according to claim 1, wherein the first and second capacitor electrodes are so disposed to oppose each other in the direction to which the first and second via conductors extend, that a capacitor is formed with the first and second capacitor electrodes.

4. The resonator according to claim 1, wherein the first capacitor electrode is provided on an inner side of the dielectric block relative to the second ground electrode, and is provided with an opening in a region corresponding to a position at which the second via conductor and the fourth via conductor are provided such that the first capacitor electrode is electrically isolated from the second via conductor and the fourth via conductor, and the second capacitor electrode is provided on the inner side of the dielectric block relative to the first ground electrode, and is provided with an opening in a region corresponding to a position at which the first via conductor and the third via conductor are provided such that the second capacitor electrode is electrically isolated from the first via conductor and the third via conductor.

5. The resonator according to claim 1, wherein the first ground electrode is provided on an inner side of the dielectric block relative to the second capacitor electrode, and is provided with an opening in a region corresponding to a position at which the second via conductor and the fourth via conductor are provided such that the first ground electrode is electrically isolated from the second via conductor and the fourth via conductor, and the second ground electrode is provided on the inner side of the dielectric block relative to the first capacitor electrode, and is provided with an opening in a region corresponding to a position at which the first via conductor and the third via conductor are provided such that the second ground electrode is electrically isolated from the first via conductor and the third via conductor.

6. The resonator according to claim 1, wherein the first to fourth via conductors are disposed in a substantially square-shaped configuration within a plane parallel to the first and second ground electrodes.

7. A bandpass filter, comprising:

a dielectric block; and a first resonator and a second resonator provided in the dielectric block, in parallel to each other, so as to be electromagnetically coupled to each other, each of the first and second resonators including:

a first ground electrode and a second ground electrode provided on or in the dielectric block so as to oppose each other;

a first via conductor provided in the dielectric block so as to extend in a direction orthogonal to faces of the first and second ground electrodes, and having a short-circuit end and an open end, the short-circuit end being connected to the first ground electrode, and the open end extending toward the second ground electrode;

a second via conductor provided in the dielectric block so as to extend in the direction orthogonal to faces of the first and second ground electrodes, and having a short-circuit end and an open end, the short-circuit end being connected to the second ground electrode, and the open end extending toward the first ground electrode;

a third via conductor provided in the dielectric block so as to extend in the direction orthogonal to faces of the first and second ground electrodes, and having a short-circuit end and an open end, the short-circuit end being connected to the first ground electrode, and the open end extending toward the second ground electrode;

a fourth via conductor provided in the dielectric block so as to extend in the direction orthogonal to faces of the first and second ground electrodes, and having a short-circuit end and an open end, the short-circuit end being connected to the second ground electrode, and the open end extending toward the first ground electrode;

a first capacitor electrode provided in the dielectric block, and connected to the first via conductor and the third via conductor; and a second capacitor electrode provided in the dielectric block, and connected to the second via conductor and the fourth via conductor, wherein every couple of via conductors immediately neighboring one another, selected from the first to fourth via conductors, are interdigitally coupled with each other, the interdigitally coupled via conductors have a first resonant mode resonating at a first resonance frequency $f_1$ which is higher than a resonance frequency $f_0$ determined by a physical length of each via conductors, and a second resonant mode resonating at a second resonance frequency $f_2$ which is lower than the resonance frequency $f_o$ and an operating frequency is set at the resonance frequency $f_2$.

8. The bandpass filter according to claim 7, wherein each of the first and second ground electrodes is configured as a common electrode serving for the first resonator as well as for the second resonator, and the filter further comprises coupling adjusting via conductors provided between the first and second resonators to penetrate the dielectric block from the common first ground electrode to the common second ground electrode, the coupling adjusting via conductor adjusting coupling magnitude between the first and second resonators.

* * * * *